US007067934B2

(12) United States Patent
Kitagawa et al.

(10) Patent No.: US 7,067,934 B2
(45) Date of Patent: Jun. 27, 2006

(54) STARTER WITH OVERHEAT PROTECTION DEVICE

(75) Inventors: Shigefumi Kitagawa, Nagoya (JP); Tomohiro Ohmura, Toyota (JP); Hideo Tanaka, Toyota (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/936,505

(22) Filed: Sep. 9, 2004

(65) Prior Publication Data

US 2005/0057046 A1 Mar. 17, 2005

(30) Foreign Application Priority Data

Sep. 12, 2003 (JP) ..... 2003-320937
Sep. 16, 2003 (JP) ..... 2003-323603
Mar. 31, 2004 (JP) ..... 2004-103912

(51) Int. Cl.
*F02N 11/00* (2006.01)

(52) U.S. Cl. ..... 290/38 R; 310/71

(58) Field of Classification Search ..... None
See application file for complete search history.

(56) References Cited

U.S. PATENT DOCUMENTS 6,008,555 A * 12/1999 Garr et al. ..... 310/68 C
6,028,381 A * 2/2000 Yumiyama et al. ..... 310/68 C
6,520,137 B1 * 2/2003 Ooizumi et al. ..... 123/179.3
6,552,890 B1 * 4/2003 Renner et al. ..... 361/104
2004/0012902 A1 1/2004 Ikeda
2004/0100351 A1 * 5/2004 Unno et al. ..... 337/100
2005/0051126 A1 * 3/2005 Oomi et al. ..... 123/179.25

FOREIGN PATENT DOCUMENTS

| | | | |
|---|---|---|---|
| DE | 19624567 | A1 * | 1/1998 |
| DE | 100 41 822 | A1 | 3/2002 |
| DE | 101 13 733 | A1 | 9/2002 |
| EP | 1 111 736 | A2 | 6/2001 |
| FR | 2 785 086 | | 4/2000 |
| GB | 173889 | | 1/1922 |
| JP | A 4-64972 | | 6/1992 |
| JP | A 10-66311 | | 3/1998 |
| JP | WO 00/19091 | | 4/2000 |
| WO | WO 216763 | A1 * | 2/2002 |

OTHER PUBLICATIONS

Translation to English of WO02/16763 A1.*

* cited by examiner

*Primary Examiner*—Joseph Waks
(74) *Attorney, Agent, or Firm*—Oliff & Berridge, PLC

(57) ABSTRACT

A starter capable of reliably and safely cutting off or breaking a motor circuit when the motor circuit is subjected to an excessively large thermal load is disclosed. The motor circuit includes an intermediate member made of metal and electrically connected between a motor lead wire and a positive-side brush lead wire. The intermediate member has a fuse function that undergoes melting to cutoff the motor circuit when a thermal load excessively larger than that in normal use occurs in the motor circuit.

21 Claims, 17 Drawing Sheets

STARTER WITH OVERHEAT PROTECTION DEVICE

BACKGROUND OF THE INVENTION

1. Field of the Invention

The present invention relates to a starter for starting up an internal combustion engine, and more particularly to such a starter which is equipped with an overheat protection device.

2. Description of the Related Art

In general, at a start of a motor vehicle engine, the user manually controls operation of a starter through manipulation of a key switch. In this instance, if a return failure of the start switch or a like abnormal condition occurs, an armature coil may undergo dielectric breakdown to cause a short-circuit between coils whereupon a large current of several hundreds amperes is continuously supplied from a power source to a starter motor for a long time, thus exerting an excessively large thermal load onto the starter. Alternatively, if for some reason a failure occurs with an electromagnetic switch, the starter motor may be continuously energized under a no-load condition.

To cope with abnormal conditions involving excessively large thermal loads, it may be considered that the starter motor be electrically separated from the power source by using some means. Typical examples of such prior considerations are disclosed in Japanese Utility Model Laid-open Publication (JP-UM-A) No. 04-64972, International Publication No. WO 00/19091, Japanese Patent Laid-open Publication (JP-A) No. 10-66311, and French Patent Laid-open Publication (FR-A) No. 2785086.

In a starter disclosed in JP-UM-A 04-64972, a brush lead wire (brush pigtail) has a portion with reduced cross-section to provide a fuse function so that when a starter motor is continuously energized for a long time, the portion of reduced cross-section undergoes melting or fusion to cut down an electric circuit including the brush lead wire. However, since the brush lead wire is made of copper, the melting temperature of the bush lead wire is above 1,100° C. Furthermore, owing to good thermal conductivity of copper, the brush lead wire made of copper, even after melting, is able to transmit high temperature to and eventually damage neighboring components. This poses a problem in terms of safety.

Furthermore, in the case of a starter using a permanent magnet in a field system of an electric motor, since, as shown in FIG. 20 hereof, a brush lead wire 200 is directly connected or otherwise welded to a motor lead wire 210, a joint portion between these lead wires 200, 210 is disposed near a grommet 220 in which the motor lead wire 210 is supported. In this arrangement, if the brush lead wire 200 is configured to have a fuse function, the grommet 220 may be damaged under the effect of a high temperature produced when the brush lead wire 200 is melting.

For the brush lead wire, the motor lead wire or a like wire which is formed by a number of fine conductors bundled together it is very difficult to form a weld connection between these wires because of a large contact resistance between adjacent conductors. Thus, the brazing is used in place of the welding. The brazing is, however, relatively low in productivity as compared to the welding and hence increases the production cost.

A starter disclosed in WO 00/19091 has a thermal fuse incorporated in a motor circuit such that when heated at a predetermined temperature, the thermal fuse undergoes melting or fusion to cut off or open the motor circuit. In the disclosed arrangement, however, since the thermal fuse is disposed outside the starter, it is necessary to preclude interference between the thermal fuse and peripheral components of the starter (such as engine accessories, electric wirings and so on). This requirement may deteriorate mountability of the starter with respect to the motor vehicle. The thermal fuse, which is formed as a separate part structurally independent from the motor circuit, increases a number of component parts of the starter and increases the manufacturing cost of the starter.

Starters disclosed in JP-A 10-66311, and FR-A 2785086 include a motor read wire or a brush lead wire (pigtail) having a recessed portion of reduced cross-section, which is fusible to break a motor circuit when heated to a predetermined temperature as an overcurrent passes through the recessed portion. In the disclosed starters, since the recessed portion is formed in a motor lead wire or a brush lead wire of high thermal conductivity, high temperatures generated at the recessed portion is allowed to readily escape therefrom via thermal conduction through the lead wire itself. Accordingly, in order to make sure that melting occurs at the recessed portion, it is necessary reduce the cross-section of the recessed portion to a considerable extent. This requirement, however, increases the risk of a break, which may occur when the locally recessed lead wire is subjected to vibrations during travel of the motor vehicle. Additionally, for a motor circuit in which the lead wire is used, a local reduction in cross section of the lead wire directly leads to an increase in the circuit resistance, which will lower the output of the starter.

SUMMARY OF THE INVENTION

With the foregoing problems in view, it is an object of the present invention to provide a starter having a fuse function or device which, when a current flow path of the starter is subjected to an excessively larger thermal load than in normal use, is capable of reliably and safely breaking the current flow path without requiring a separate thermal fuse disposed outside the starter and without reducing the output of the starter.

To achieve the foregoing object, according to a first aspect of the present invention, there is provided a starter comprising: an electric motor producing a rotational force when supplied with a start-up current, the electric motor having a frame and a grommet mounted on the frame; a motor circuit for the passage therethrough of the start-up current from a battery to the electric motor; and an electromagnetic switch disposed in the motor circuit for selectively allowing and blocking flow of the start-up current through the motor circuit. The motor circuit comprises: a motor lead wire passing through the grommet and having a first end portion disposed outside the frame and connected with the electromagnetic switch and a second end portion disposed inside the frame; a motor internal circuit disposed internally of the electric motor and forming a current flow path through which the start-up current supplied via the motor lead wire flows; and an intermediate member made of metal and electrically connected either between the motor lead wire and the motor internal circuit or to an intermediate portion of the motor internal circuit. The intermediate member has a fuse function that undergoes melting to thereby break the motor circuit when the motor circuit is subjected to a thermal load excessively larger than that in normal use.

With this arrangement, when a thermal load excessively larger than that in normal use occurs in the motor circuit, the intermediate member having a fuse function undergoes melting or fusion to thereby cutoff or break the motor circuit. By thus breaking the motor circuit, continued energization of the motor can be avoided.

In the case where the intermediate member is disposed between the motor lead wire and the motor internal circuit, the motor lead wire and the motor internal circuit do not require direct connection by brazing, for example. Rather, the motor lead wire and the motor internal circuit are allowed to be connected to the intermediate member. In this instance, since the motor lead wire and the motor internal circuit are joined by welding to a metal surface of the intermediate member, the efficiency of this joining process is considerably high as compared to the efficiency of a direct brazing process where hard-to-weld lead wires are to be connected together.

In one preferred form of the invention, the motor internal circuit includes a connection bar forming a part of the current flow path, the connection bar being divided into a first bar member and a second bar member. The intermediate member is disposed between the first bar member and the second bar member, and the first and second bar members are electrically connected to the intermediate member.

Since the intermediate member is disposed in an intermediate portion of the connecting bar, it is possible to provide a relatively large space between the fusible intermediate member and the rubber grommet which is easily affected by heat. With this arrangement, when the intermediate member is melting, less heat can be transmitted to the grommet. The grommet is thus protected from being damaged by heat at high temperatures. Furthermore, the position of the intermediate member can be changed depending on the position of separation of the connection bar. Stated in other words, the intermediate member can be located at any position on the connecting bar and hence has a higher degree of design freedom. Limits in the size and configuration of the intermediate member that are determined by special conditions are considerably mitigated.

In another preferred form of the invention, the motor internal circuit includes a connection bar forming a part of the current flow path, and the intermediate member is disposed between the connection bar and the second end portion of the motor lead wire. The connecting bar and the second end portion of the motor lead wire are electrically connected to the intermediate member.

In still another preferred form of the present invention, the motor internal circuit includes a connection bar forming a part of the current flow path and an internal conductor disposed on a low potential side of the connection bar. The intermediate member is disposed between the connection bar and the internal conductor, and the connecting bar and the internal conductor are electrically connected to the intermediate member.

By thus arranging the intermediate member on the low potential side of the connection bar, it is possible to provide a relatively large space between the fusible intermediate member and the rubber grommet which is readily affected by heat. When the intermediate member is melting, less heat can be transmitted to the grommet. The grommet is kept substantially free from damage by heat.

In another preferred form of the invention, the motor internal circuit includes a brush lead wire forming a part of the current flow path and connected to a positive brush of the electric motor. The intermediate member is disposed between the brush lead wire and the second end portion of the motor lead wire. The brush lead wire and the second end portion of the motor lead wire are electrically connected to the intermediate member.

With this arrangement, the motor lead wire and the brush lead wire do not require direct joining by brazing which is low in efficiency. Instead, the motor and brush lead wires are connected by welding to the intermediate member. The welding operation using the intermediate member is highly efficient as compared to the brazing.

In still another preferred form of the invention, the motor internal circuit includes a field coil forming a part of the current flow path, and the intermediate member is disposed between the field coil and the second end portion of the motor lead wire. The field coil and the second end portion of the motor lead wire are electrically connected to the intermediate member.

With this arrangement, the motor lead wire and the field coil do not require direct joining by brazing but are allowed to be connected by welding to the intermediate member. The welding operation using the intermediate member is highly efficient as compared to the brazing.

Preferably, the intermediate member is formed from a material having a larger electric resistance than the motor lead wire and the motor internal circuit and a lower thermal conductivity than the motor lead wire and the motor internal circuit.

Since the fuse function is assigned to the intermediate member of larger electric resistance, the intermediate member will reliably undergo melting to break the motor circuit when the motor circuit is subjected to a thermal load excessively larger than that in normal use. Additionally, since the intermediate member has a lower thermal conductivity than the motor lead wire and the motor internal circuit, less heat can be transmitted from the intermediate member that is melting to neighboring parts. This ensures that the grommet is effectively protected from the effect of high temperatures.

It is preferable that the intermediate member has a restricted portion of reduced cross-section forming a part of the current flow path through which the start-up current flows.

With the restricted portion thus provided, melting of the intermediate member will occur only at the restricted portion. This will increase the reliability of the melting operation (fuse function) of the intermediate member.

The intermediate member may be a generally T-shaped configuration having three protrusions. One of the three protrusions forming a central stem of the T-shaped configuration is connected to the motor lead wire, and the remaining protrusions forming arms of the T-shaped configuration are connected to the motor internal circuit. The intermediate member of the T-shaped configuration has a cutout recess formed between the one protrusion and each of the remaining protrusions so that a restricted portion having a reduced cross-section is formed. The restricted portion forms a part of a current flow path extending between the one protrusion and each of the remaining protrusions.

With this arrangement, when the motor circuit is subjected to a thermal load excessively larger than that in normal use, the intermediate member will undergo melting or fusion at the restricted portion.

Preferably, the intermediate member is made of iron. Iron has an electric resistance approximately six times as large as the electric resistance of copper generally used as a material for the lead wires. This means that the intermediate member made of iron undergoes melting earlier than the lead wires made of copper. Additionally, the thermal conductivity of iron is one-fifth of the thermal conductivity of copper. This means that transmission of heat from the intermediate member to the motor lead wire and the motor internal circuit is sufficiently suppressed. Furthermore, iron is easily available and inexpensive, which contributes to the reduction of cost.

The intermediate member preferably comprises a plate-like member having a surface to which the motor lead wire and/or a part of the motor internal circuit is welded. The plate-like intermediate member is well suited for press-forming operation and is inexpensive to manufacture. Furthermore, the plate-like intermediate member can provide a relatively large surface area available for welding to the motor lead wire and the motor internal circuit. The large surface area facilitates a smooth welding operation and increases the efficiency of the welding process to a higher level than as attained by a conventional welding process in which hard-to-weld lead wires are directly connected together by brazing.

Preferably, the surface of the plate-like intermediate member has a surface treatment to secure a desired welding strength.

In general, those components used in the motor circuit, including the motor lead wire and the motor internal circuit are made of copper in order to lower the internal electric resistance of the motor. The intermediate member is made of iron which is a material having a relatively high melting temperature. When two such materials of relatively high melting temperatures are welded together, difficulty may arise in that the resulting welding strength is insufficient to withstand vibrations produced during travel of the motor vehicle. To deal with this difficulty, the surface of the intermediate member is treated with a layer of material having a low melting point. Typical example of such surface treatment is tinning. The surface-treated intermediate member has an improved degree of weldability, can provide a welding strength large enough to withstand vibrations during travel of the motor vehicle without causing accidental separation, and is capable of performing the fuse function with increased reliability.

In a second aspect, the invention provides a starter comprising: an electric motor including a field system, an armature, a commutator disposed on the armature, and brushes disposed on the commutator, the motor generating a rotational force via the armature when a start-up current is supplied from a battery to the armature; an electromagnetic switch having a battery terminal connected to the battery and a motor terminal connected to the motor, the electromagnetic switch being operable to electrically connect and disconnect the battery terminal and the motor terminal; a current flow path formed inside the starter for the passage therethrough of the start-up current; and plural circuit parts electrically connected together to form the current flow path. A selected one of the plural circuit parts has a conduction cut-off function that undergoes melting to cutoff the current flow path when the current flow path is subjected to a thermal load excessively larger than that in normal use. The selected circuit part is reduced in cross-sectional area over a length larger than one-half of the entire length of the selected circuit part so as to perform the conduction cut-off function.

By thus reducing the cross-sectional area of the selected circuit part, it is possible to provide a portion of high current density in the current flow path. When the current flow path is subjected to an excessively large thermal load, the high current density portion generates Joule heat and eventually undergoes melting or fusion to thereby cutoff the current flow path. This arrangement does not require a separate thermal fuse or a bimetal which will increase the cost of the starter. Furthermore, since the conduction cut-off function is provided by reducing the cross-sectional area of the selected circuit part over a length not less than half the entire length of the selected circuit part and not by locally restricting the cross-sectional area as done in the conventional arrangement, a temperature drop caused due to conduction of heart can be suppressed. Additionally, since the heat generated from the the selected circuit part of reduced cross-section can be used efficiently to cause melting in a short time with high reliability, there is no need to greatly reduce the cross-sectional area of the selected circuit part as in the case of the prior arrangement. Moreover, differing from the conventional arrangements discussed previously, the selected circuit part is free from local stress concentration because the cross-sectional area of the selected circuit part is reduced over at least one-half of the entire length of the selected circuit part. Thus, reduction in the cross-sectional area does not cause a noticeable reduction in the mechanical strength of the selected circuit part. The selected circuit part is highly resistant to a break, which would otherwise occur due to vibrations during travel of the motor vehicle.

Preferably, the selected circuit part is disposed inside the electric motor. Thus, melting of the selected circuit part gives almost no thermal effect on component parts and wire-harnesses of the motor vehicle disposed around the starter. The motor circuit can be, therefore, cut-off safely.

In one preferred form of the invention, the field system comprises a yoke forming a magnetic circuit, field poles fixedly mounted on an inner periphery of the yoke, and field coils wound around the respective field poles, and the selected circuit part having the conduction cut-off function is formed by the field coils. Since the field coils have a long length, it is possible to obtain the necessary thermal energy for melting without requiring undue reduction of the cross-sectional area.

It is preferable that each of the field coils has a cross-sectional area reduced over the entire length of the field coil so as to perform the conduction cut-off function. This arrangement allows the use of a conductor with a smaller diameter, which contributes to the reduction of the cost.

Preferably, each of the field coil has a winding-start end portion and a winding-finish end portion opposite the winding-start end portion, and at least one of the winding-start end portion and the winding-finish end portion is prestressed with a tension imparted thereto. Upon melting, the prestressed end portion automatically separates into two parts. This will increase the reliability of the conductor cut-off operation.

The plural circuit parts excluding the selected circuit part may include a high-temperature avoidance part disposed adjacent to or in contact with a flammable part of the motor, the high-temperature avoidance part having a largest cross-sectional area and a smallest current density among the plural circuit parts.

Preferably, the current density of the high-temperature avoidance part is about one-half of a current density of a portion of the selected circuit part having a reduced cross-sectional area.

The high-temperature avoidance part comprises a motor lead wire supported by a grommet made of rubber and forming the flammable part, the motor lead wire having a first portion disposed outside the motor and connected at an end to the motor terminal and a second portion disposed inside the motor.

In an alternate form, the high-temperature avoidance part comprises a motor lead wire supported by a grommet made of rubber and forming the flammable part, and a connection bar held by an insulator formed from a resin and forming the flammable part, the motor lead wire having a first portion disposed outside the motor and connected at an end to the motor terminal and a second portion disposed inside the motor, the connecting bar electrically connecting the motor lead wire and the field coils.

By virtue of the reduced current densities, the high-temperature avoidance part (the motor lead wire and the connection bar) generates less heat than the conventional components with the result that the grommet and the insulator that are formed from flammable material are protected from the effect of high temperature.

DETAILED DESCRIPTION OF THE PREFERRED EMBODIMENTS

Figure 1:
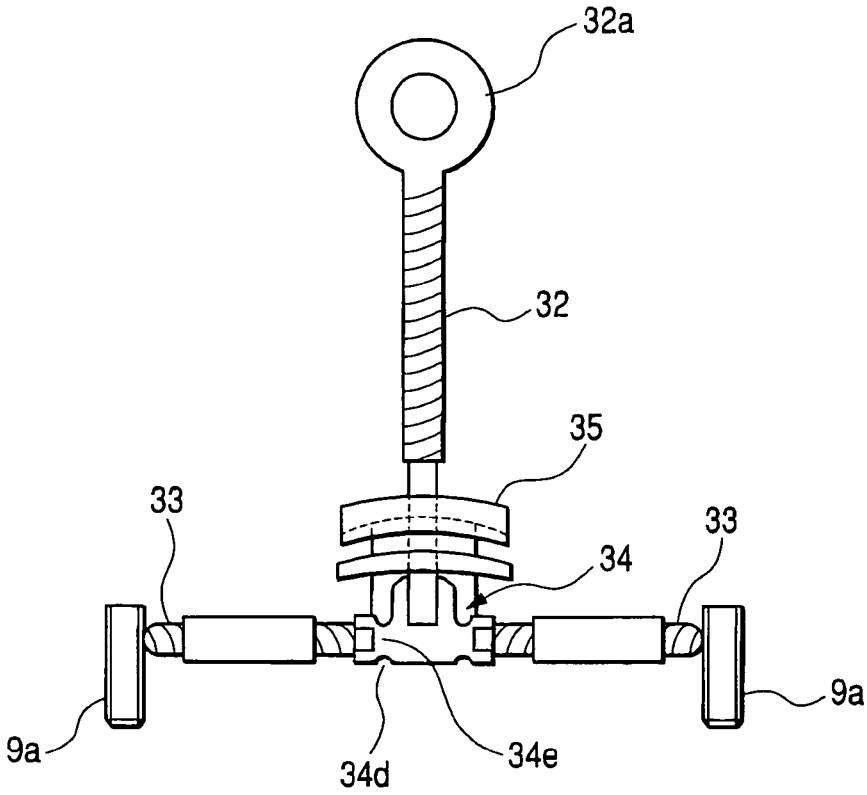
FIG. 1 is a plan view showing an intermediate plate and a part of a motor circuit connected to the intermediate plate according to a first embodiment of the present invention.

Certain preferred structural embodiments of the present invention will be described in detail hereinbelow, by way of example only, with the reference to the accompanying sheets of drawings, in which identical or corresponding parts are denoted by the same reference characters throughout the figures.

Figure 3:
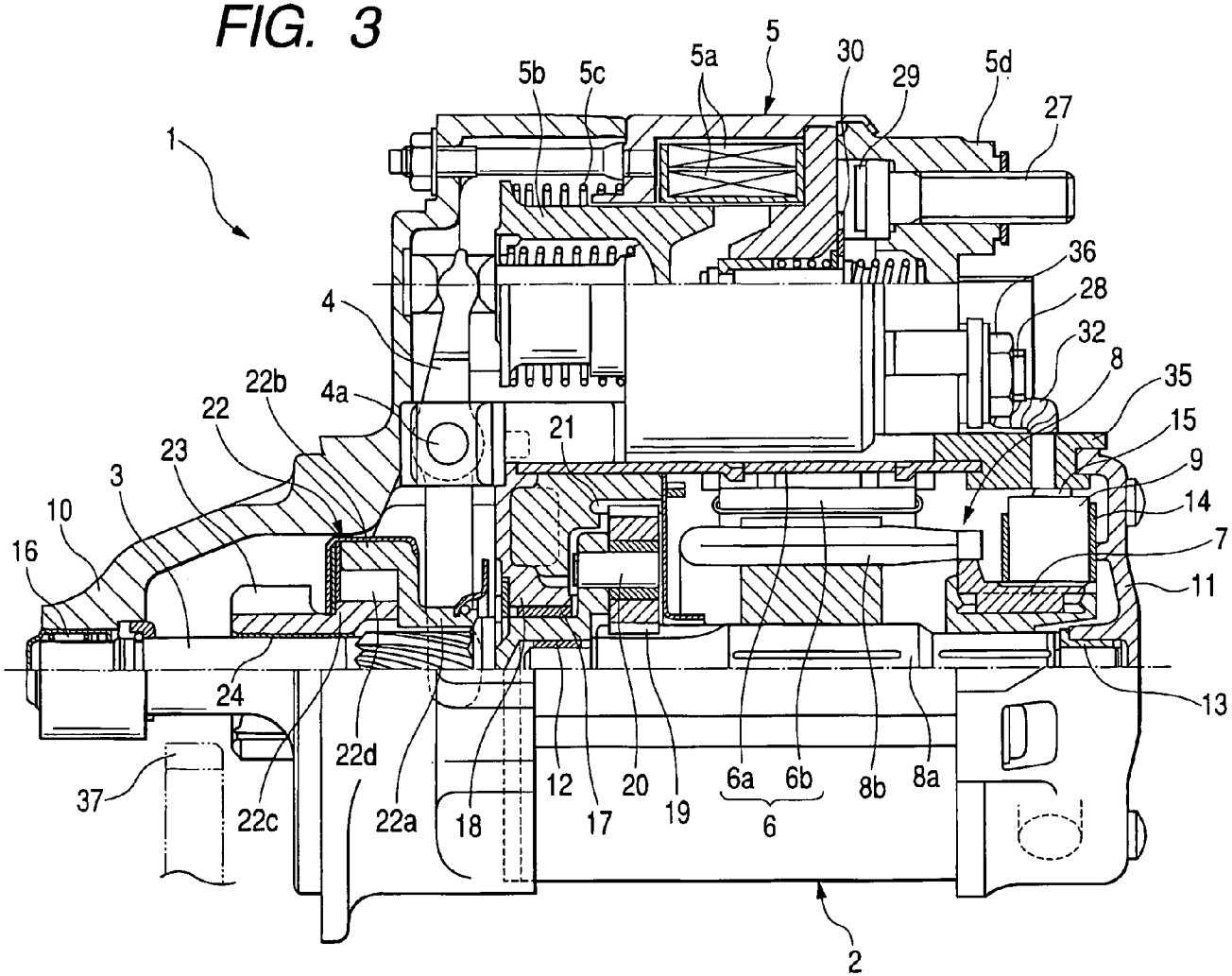
FIG. 3 is a half cross-sectional view of a starter according to the first embodiment of the present invention.

FIG. 1 shows in plan view an intermediate plate (intermediate member) 34 having the function of a fuse and a part of a motor circuit connected to the intermediate plate 34 according to a first embodiment of the present invention. FIG. 3 shows in half cross section a starter 1 according to the first embodiment of the invention.

Figure 4:
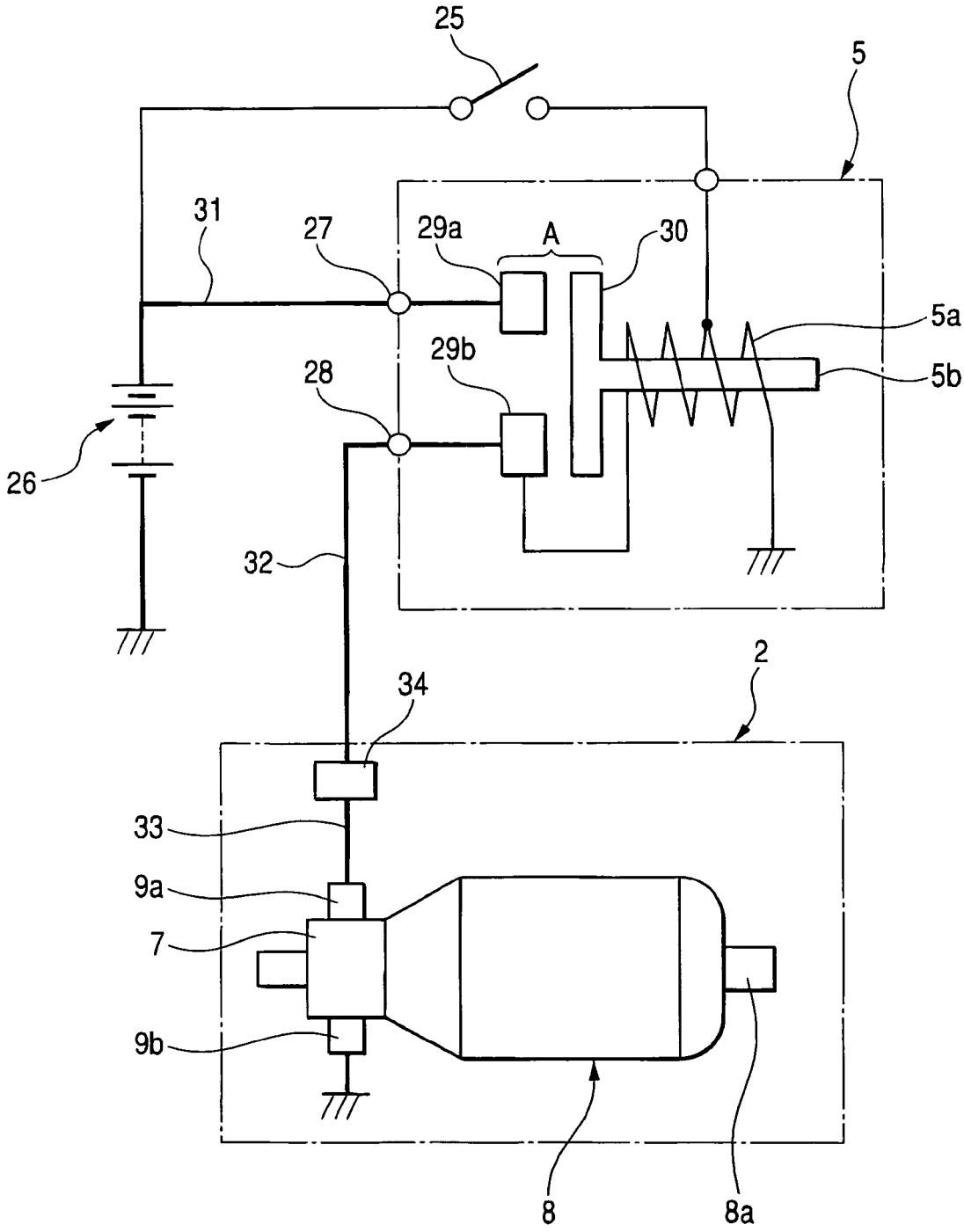
FIG. 4 is a circuit diagram of the starter.

As show in FIG. 3, the starter 1 generally comprises a motor 2 for generating a rotational force, an output shaft 3 driven in rotation by the motor 2, a pinion displacing member (described later) mounted on the output shaft 3, and an electromagnetic switch 5 doubles in function to force the pinion displacing member in a direction (leftward in FIG. 3) away from the motor via a shift lever 4 and to open and close a contact means A (described later) provided in a motor circuit (FIG. 4).

The motor 2 comprises a direct-current (dc) motor known per se and includes a field system 6 for producing a magnetic flux, an armature 8 having a commutator 7, and brushes 9 disposed on the commutator 7.

The field system 6 is composed of a hollow cylindrical yoke 6*a* and a plurality of permanent magnets 6*b* disposed on an inner periphery of the cylindrical yoke 6*a*. The yoke 6*a* is held between a front housing 10 and an end frame 11 so as to form a magnetic circuit. The yoke 6*a* serves also as a frame of the motor 2. The plural permanent magnets 6*b* are spaced at equal intervals in a circumferential direction of the yoke 6*a*.

The armature 8 has an armature shaft 8*a* forming a rotating shaft of the motor 2. The armature shaft 8*a* has a first end (left end in FIG. 3) rotatably supported by the output shaft 3 via a bearing 12 and a second end (right end in FIG. 3) rotatably supported by the end frame 11 via a bearing 13. The output shaft 3 and the armature shaft 8*a* are rotatable relative to each other.

The commutator 7 is composed of a plurality of segments electrically insulated from one another and arranged to form a cylinder fixedly mounted on a rear end portion (right end portion in FIG. 3) of the armature shaft 8*a*. Each of the segments of the armature 7 is electrically and mechanically connected to a respective one of plural armature coils 8*b* of the armature 8.

The brushes 9, as shown in FIG. 4, are composed of a positive brush 9*a* disposed on a positive (or plus) side of the armature 8, and a negative brush 9*b* disposed on a negative (or minus) side of the armature 8. Each of the brushes 9*a*, 9*b* is held in a brush holder 14 (FIG. 3) and disposed on an outer periphery of the commutator 7 such that each brush 9*a*, 9*b* is held in contact with an outer peripheral surface of the commutator 7 under the force of a brush spring 15 (FIG. 3).

The output shaft 3 is disposed in coaxial relation to the armature shaft 8*a* via a speed reducer (described later). The output shaft 3 has one end (left end in FIG. 3) rotatably supported by the front housing 10 via a bearing 16 and an opposite end rotatably supported by a center case 18 via a bearing 17.

The speed reducer comprises a known planetary gear mechanism constructed to reduce a rotational speed of the armature 8 to a revolution speed of a planetary gear 19. Rotation (revolving motion) of the planetary gear 19 is transmitted to the output shaft 3 via a gear shaft 20 on which the planetary gear 19 is supported.

The center case 18 is disposed in an open end (right end in FIG. 3) of the front housing 10 so as to confine rotation of an internal gear 21.

The pinion-displacing member is comprised of a one-way clutch (also called "freewheeling clutch" or "overrunning clutch") 22 and a pinion gear 23. The one-way clutch 22 is provided for transmitting rotation of the output shaft 3 to the pinion gear 23. To this end, the one-way clutch 22 is composed of a spline tube 22*a* connected via helical spline engagement with the output shaft 3, an outer race 22*b* formed integrally with the spline tube 22*a*, an inner race 22*c* disposed inwardly of the outer race 22*b*, and rollers 22*d* disposed in a wedge-shaped space defined between the outer and inner races 22*b*, 22*c*. The pinion gear 23 is disposed on a side (left side in FIG. 3) of the inner race located opposite the motor 2. The pinion gear 23 is formed integrally with the inner race 22*c* of the one-way clutch 22 and supported rotatably on the output shaft 3 via a bearing 24.

The electromagnetic switch 5 comprises an exciting coil 5*a* generating a magnetic force when energized with a current from a battery 26 upon closing operation of a start switch 25 (FIG. 5), a plunger 5*b* inserted in the exciting coil 5*a* for linear reciprocating movement such that when the exciting coil 5*a* is energized, the plunger 5*b* is displaced rightward in FIG. 3 due to attraction caused by a magnetic force generated by the exciting coil 5*a*, and a return spring 5*c* urging the plunger 5*b* leftward in FIG. 3 so that when the exciting coil 5*b* is de-energized, the plunger 5*b* returns to its original position shown in FIG. 3 by the force of the return spring 5*c*.

The shift lever 4 connects the plunger 5*b* of the electromagnetic switch 5 to the spline tube 22*a* of the one-way clutch 22. The shift lever 4 is pivotally movable about its supporting point 4*a* so that a motion of the plunger can be transmitted to the pinion-displacing member.

The contact means A comprises a pair of fixed contacts 29 (29*a*, 29*b* shown in FIG. 4) connected via two external terminals 27, 28 to the motor circuit, and a movable contact 30 linked in motion with the movement of the plunger 5*b* (or movable in unison with the plunger 5*b*). When the movable contact 30 is in contact with the fixed contacts 29 to make or complete an electrical connection between the fixed contacts 29 together, the contact means A is in a closed state. Alternatively, the contact means A is in an open state when the movable contact 30 is out of contact with the fixed contacts 29 to break the electrical connection between the fixed contacts 29.

The external terminals 27, 28 comprise a battery terminal 27 electrically and mechanically connected to one fixed contact 29*a* (FIG. 4), and a motor terminal 28 electrically and mechanically connected to the other contact 29*b* (FIG. 4). The battery terminal 27 and the motor terminal 28 are both fixedly mounted to a contact cover 5*d*. The battery terminal 27 has a threaded portion (not designated) projecting outwardly from the contact cover 5*d* for connection with a battery cable 31 (FIG. 4). The motor terminal 28 also has a threaded portion projecting outwardly from the contact cover 5*d*, and a motor lead wire 32 is connected to the projecting threaded portion of the motor terminal 28.

The motor circuit, as shown in FIG. 1, includes the motor lead wire 32, two brush lead wires 33 connected to the positive brushes 9*a*, the intermediate plate (intermediate member) 34 electrically connected between the motor lead wire 32 and each of the brush lead wires 33.

The motor lead wire 32 extends through a grommet 35 attached to the end frame 11 (FIG. 3) and has a first portion disposed outside the end frame 11 and a second portion disposed inside the end frame 11. The first end portion of the motor lead wire 32 has a ring-like terminal part 32*a* formed at a distal end thereof opposite the grommet 35. The terminal part 32*a* is fitted around the threaded portion of the motor terminal 28 and firmly secured to the motor terminal 28 by a nut 36 (FIG. 3). The second end portion of the motor lead wire 32 is welded, at an end remote from the grommet 35, to a surface of the intermediate plate 34, as shown in FIG. 1.

The grommet 35 is made of rubber and has a circular through-hole formed at a central portion thereof for the passage therethrough of the motor lead wire 32. The grommet 35 is attached to the end frame 11 so that the motor lead wire 11 is held in an electrically insulated condition relative to the end frame 11.

As shown in FIG. 1, each of the brush lead wires 33 has one end electrically and mechanically connected to a respective one of the positive brushes 9*a* and an opposite end welded to the surface of the intermediate plate 34.

Figure 2:
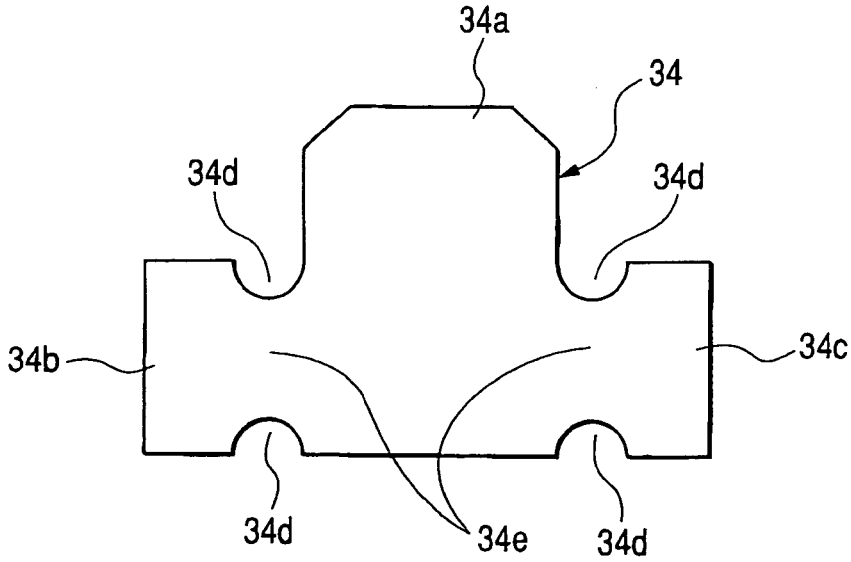
FIG. 2 is an enlarged plan view of the intermediate plate.

The intermediate plate 34 has a fuse function that is able to cut off or break the motor circuit by fusing or melting itself when a thermal load excessively larger than that in normal use occurs in the motor circuit. The intermediate plate 34 is made of iron, for example. As shown in FIGS. 1 and 2, the intermediate plate 34 is press-formed into a generally T-shaped configuration having three protrusions 34*a*, 34*b* and 34*c*. A central protrusion 34*a* (FIG. 2), which forms a central stem of the T-shaped configuration, is connected to the motor lead wire 32. Left and right protrusions 34*b* and 34*c* (FIG. 2), which are disposed on opposite sides of the central protrusion 34*a* and form arms of the T-shaped configuration, are connected to the brush lead wires 33. Thus, the motor lead wire 32 and the brush lead wires 33 are electrically connected together by the intermediate plate 34. The intermediate plate 34 also has a cutout recess 34*d* formed between the central protrusion 34*a* and each of the left and right protrusions 34*b*, 34*c*. By thus providing the cutout recess 34*d*, the intermediate plate 34 has a restricted portion 34*e* with reduced cross-section.

More specifically, as shown in FIG. 2, the intermediate plate 34 is of a generally T-shape configuration having three protrusions 34*a*, 34*b*, 34*c* oriented in different directions. In this regard, the intermediate plate 34 may be also called a generally triangular intermediate plate. One 34*a* of the three protrusions 34*a*, 34*b*, 34*c* is connected to the motor lead wire 32 (FIG. 1), and the remaining two protrusions 34*b*, 34*c* are connected to the brush lead wires 33, 33 (FIG. 1). The cutout recess 34*d* is formed at a corner between the central protrusion 34*a* and each of the left and right protrusions 34*b*, 34*c* and at a position on a side of the left or right protrusion 34*b*, 34*c* which is opposite to the central protrusion 34*a* and corresponds in position to the afore-said corner. Thus, the intermediate plate 34 in the illustrated embodiment has a total of four cutout recesses 34*d*.

The cutout recesses 34*d* formed at the respective corners between the central protrusion 34*a* and the left and right protrusions 34*b*, 34*c* has a U-shaped configuration extending deeper toward the sides of the left and right protrusions 34*b*, 34*c* opposite the central protrusion 34*a*. Similarly, the cutout recesses 34*d* formed on the sides of the left and right protrusions 34*b*, 34*c* at positions corresponding to the respective corners also have a U-shaped configuration extending deeper toward the corresponding U-shaped cutout recesses 34*d*. The protrusions 34*a*, 34*b*, 34*c* each have a cross-sectional area and a surface area that are so determined as to ensure an easy-to-bond characteristic and a desired bonding strength of the protrusions 34*a*, 34*b*, 34*c* relative to the motor lead wire 32 and the brush lead wires 33.

By thus providing the U-shaped cutout recesses 34*d*, there are two restricted portions 34*e* with reduced cross-section that are located at junctions between the central protrusion 34*a* and the left and right protrusions 34*b* and 34*c*. The restricted portions 34*e* each form a melting portion that is fusible when a thermal load excessively larger than in normal use occurs in the motor circuit including the restricted portions 34*e*. Since the restricted portions 34*e* are disposed closer to the left and right protrusions 34*b*, 34*c* than to the central protrusion 34*a*, there can be provided a distance between the melting portions (restricted portions) 34*e* and the grommet 35 that are easily affected by high temperatures.

Preferably, an outer surface of the intermediate plate 34 has a surface treatment such as tinning so as to secure a desired welding strength between the surface-treated intermediate plate 34 and the motor and brush lead wires 32, 33.

The starter 1 of the foregoing construction will operate as described below.

At first, the start switch 25 (FIG. 4) is manually turned on or closed whereupon the exciting coil 5*a* of the electromagnetic switch 5 is energized to attract or pull the plunger 5*b* rightward in FIG. 3 into the exciting coil 5*a*. The rightward movement of the plunger 5*b* causes the shift lever 4 to turn clockwise in FIG. 3 about the support point 4*a*, thus forcing the pinion-displacing member to move leftward on and along the output shaft 3. With this leftward movement of the pinion displacing member, the pinion gear 23 comes in abutment with an end face of a ring gear 37 (FIG. 3) of a motor vehicle engine with which the starter 1 is associated. Upon abutment, leftward movement of the pinion gear 23 is interrupted.

The rightward movement of the plunger 5 also causes the contact means A to close whereupon the armature 8 is energized and thus begins to rotate. Rotation of the armature 8 is reduced by the speed reducer (planetary gear mechanism) and thereafter transmitted to the output shaft 3.

The output shaft 3 is thus rotated at a reduced speed. Rotation of the output shaft 3 is transmitted via the one-way clutch 22 to the pinion gear 23. Upon rotation, the pinion gear 23 first moves angularly or turns to a position where the pinion gear 23 is able to come in meshing engagement with the ring gear 37. After mutual meshing engagement is completed between the pinion gear 23 and the ring gear 37, a rotational force is transmitted from the pinion gear 23 to the ring gear 37, thereby cranking the engine.

After the engine is started up, the start switch 25 is turned off or opened whereupon the exiting coil 5*a* is de-energized to thereby allow the plunger 5*b* to move leftward in FIG. 3 to its original position by the force of the return spring 5*c*. With this leftward movement of the plunger 5*b*, the contact means A is opened to thereby de-energize the motor 2, and the pinion displacing member is displaced via the shift lever 4 in a rightward direction in FIG. 3 along the output shaft 3 until the pinion displacing member assumes the original standby position shown in FIG. 3.

During the operation discussed above, if a return failure of the start switch 25 occurs or if, due to some reason, the motor 2 is continuously energized under no-load condition, the armature coil 8*b* may undergo dielectric breakdown to cause a short-circuit between coils. Under such abnormal conditions, the motor 2 is continuously energized with a large current of several hundred amperes supplied from the battery 26 with the result that the motor circuit is subjected to a thermal load excessively larger than that in normal use. During that time, the temperature of the intermediate plate 34 goes up to a predetermined temperature whereupon the intermediate plate 34 undergoes melting at the restricted portions 34*e* to thereby cutoff or break the motor circuit. Thus, continued energization of the motor 2 can be avoided.

In the starter 1 according to the first embodiment of the invention, the fuse function is assigned to the intermediate plate 34 made of iron having a larger electric resistance than copper. When a thermal load excessively larger than that in normal use occurs in the motor circuit, the iron intermediate plate 34 can reliably undergo melting earlier than the motor lead wire 32 or brush lead wires 33 each formed by fine conductors bundled together.

Additionally, since the thermal conductivity of the iron is about one-fifth of that of the copper, transmission of heat from the intermediate plate 34 being melting to the motor lead wire 32 and the brush lead wires 33 can be reduced correspondingly. By thus reducing the heat transmission, it is possible to protect the grommet 35 from the effect of high temperatures even though the grommet 35 supports the motor lead wire 32.

Furthermore, by virtue of the fuse function assigned to the intermediate plate 34 made of iron with higher electric resistance than the motor lead wire 32 or brush lead wires 33, the motor lead wire 32 and the brush lead wires 33 do not undergo reduction in mechanical strength which may occur when the fuse function is assigned to the motor lead wire 32 or the brush lead wires 33 by reducing the cross-sectional area of a selected one of the lead wires 32, 33. This arrangement ensures that the starter 1 has a higher degree of reliability.

Moreover, since iron used as a material for the intermediate plate 34 is readily available at a low cost, it is possible to reduce the production cost of the intermediate plate 34. Furthermore, the intermediate plate 34 can be readily produced through press-forming operations.

The intermediate plate 34 has four cutout recesses 34*d* arranged to provide two restricted portions 34*e* with reduced cross-section each of which is formed in a current flow path extending from a joint between the intermediate plate 34 and the motor lead wire 32 to a joint between the intermediate late 34 and each of the brush lead wires 33. By thus arranging the cutout recesses 34*d*, when a thermal load excessively larger than that in normal use occurs in the motor circuit, melting of the intermediate plate 34 will occur only at the restricted portions 34*e*. This will improve the reliability in terms of the melting position and the melting time of the intermediate plate 34.

In the starter 1 according to the first embodiment of the invention, the motor lead wire 32 and the brush lead wires 33 are electrically connected together through the intermediate plate 34. In other words, the motor lead wire 32 and the brush lead wires 33 are not required to be directly connected together but allowed to be connected by welding to a surface of the intermediate plate 34. This arrangement considerably increasers the productivity as compared to an arrangement in which hard-to-weld lead wires are directly welded together.

Furthermore, since the surface of the intermediate plate 34 has been subjected to a surface treatment process with a material of low melting point (tinning, for example), welding of the motor and brush lead wires 32, 33 to the surface of the intermediate plate 34 can be achieved with utmost ease and improved reliability. The joint portions thus formed by welding can withstand vibrations during travel of the motor vehicle without causing accidental separation. The separation-free joint portions also contribute to the improvement in the reliability of the fuse function.

Figure 5:
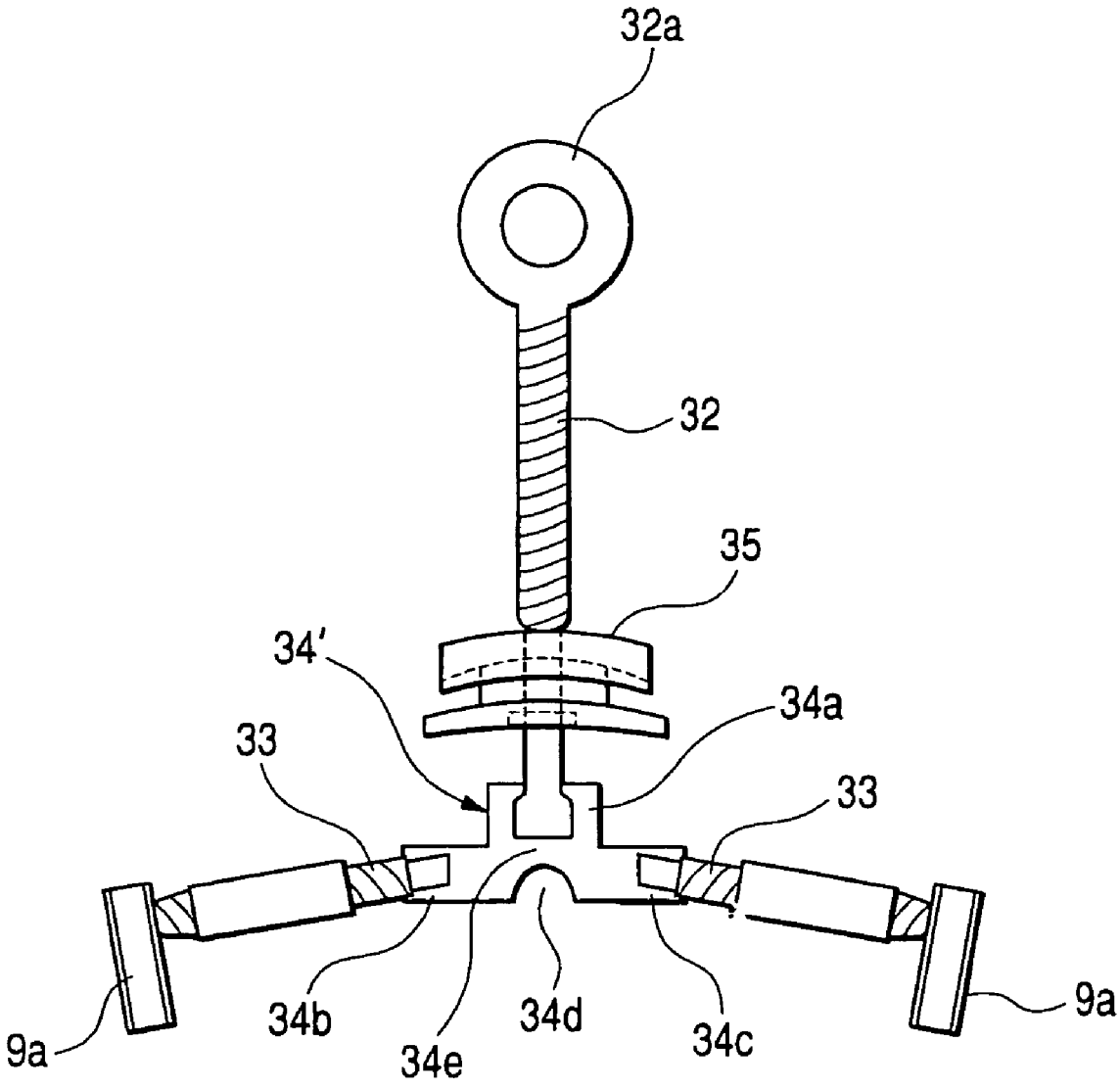
FIG. 5 is a plan view showing an intermediate plate and a part of a motor circuit connected to the intermediate plate according to a second embodiment of the present invention.

FIG. 5 shows in plan view an intermediate plate (intermediate member) 34' and a part of a motor circuit connected to the intermediate plate 34 according to a second embodiment of the present invention.

Likewise the intermediate plate 34 in the first embodiment discussed above, the intermediate plate 34' in the second embodiment shown in FIG. 5 is formed into a generally T-shaped configuration having three protrusions 34*a*, 34*b*, 34*c* oriented in different directions. A central protrusion 34*a*, which forms a central stem of the T-shaped configuration, is connected to a motor lead wire 32. Left and right protrusions 34*b*, 34*c*, which are disposed on opposite sides of the central protrusion as if they form opposite arms of the T-shaped configuration, are connected to two brush lead wires 33, 33. The intermediate plate 34' has only one cutout recess 34*d* formed in a side opposite the central protrusion 34*a* and located centrally between the left and right protrusions 34*b*, 34*c*.

The cutout recess 34*d* is formed into a semi-circular configuration (or a generally U-shaped configuration) extending from the side opposite to the central protrusion 34*a* toward the central protrusion 34*a* to which the motor lead wire 32 is connected. By the cutout recess 34*d* thus formed, two current flow paths extending in a branched fashion from the central protrusion 34*a* to the left and right protrusions 34*b*, 34*c* are equally reduced in cross section so thereby form a restricted portion 34*e* having a reduced cross-section. Each of the protrusions 34*a*, 34*b*, 34*c* has a substantially square portion, which is designed to possess a surface area and a cross-sectional area that are sufficiently large enough to ensure easy weld-connection and a desired welding strength between one of the lead wires 32, 33 and a corresponding one of the protrusions 34*a*, 34*b*, 34*c*.

The intermediate plate 34' in the second embodiment is substantially the same in construction as the intermediate plate 34 but differs therefrom in the number and position of the cutout recess 34*d*. The intermediate plate 34' thus constructed has a fuse function so that when a thermal load excessively larger than that in normal use occurs in the motor circuit, the intermediate plate 34' is fusible at the restricted portion 34*e* of reduced cross-section to break the motor circuit. Thus, continued energization of the motor 2 can be avoided.

Figure 6:
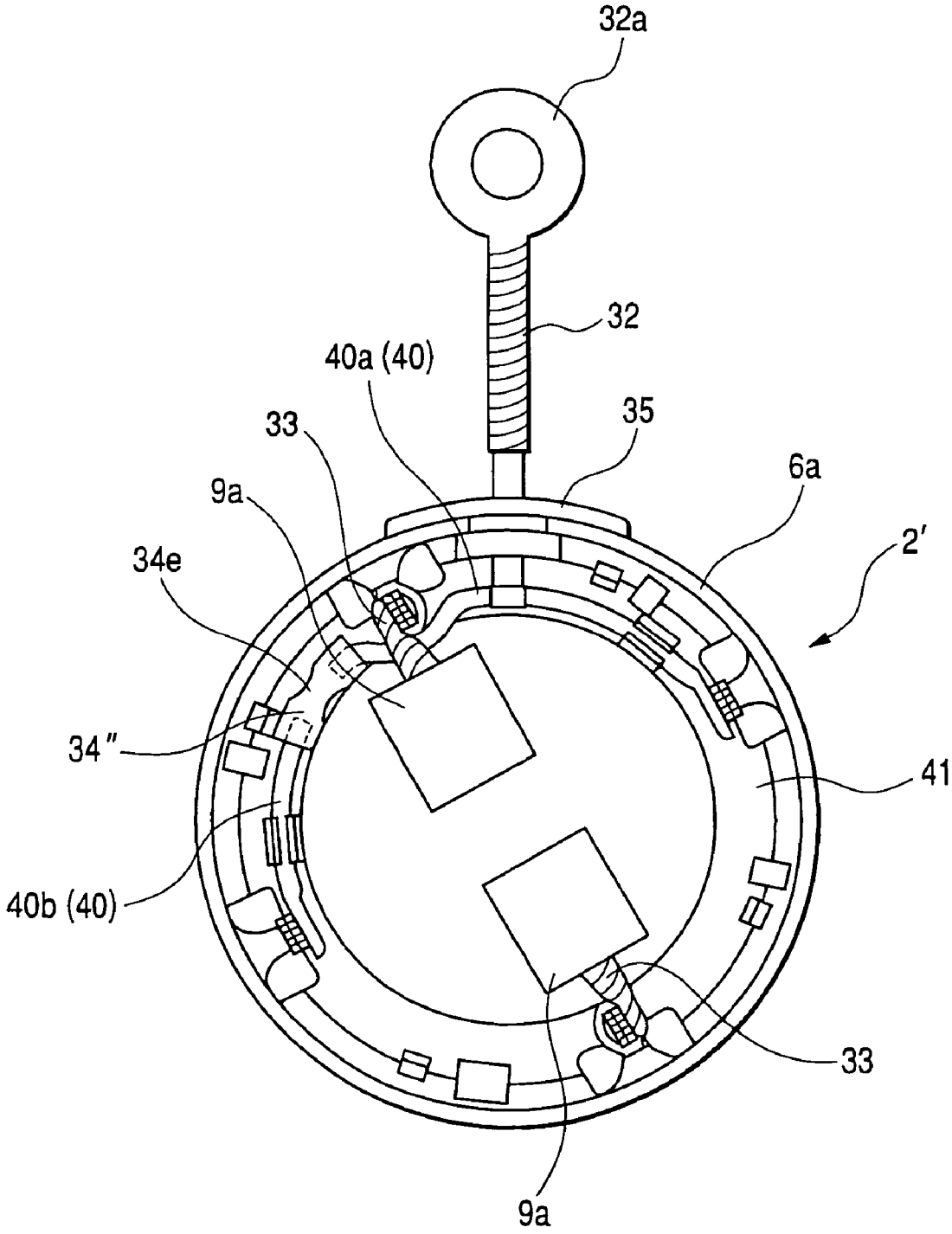
FIG. 6 is a plan view, looking in a direction of the axis of the starter of FIG. 3, showing an internal circuit of a motor according to a third embodiment of the present invention.
Figure 7:
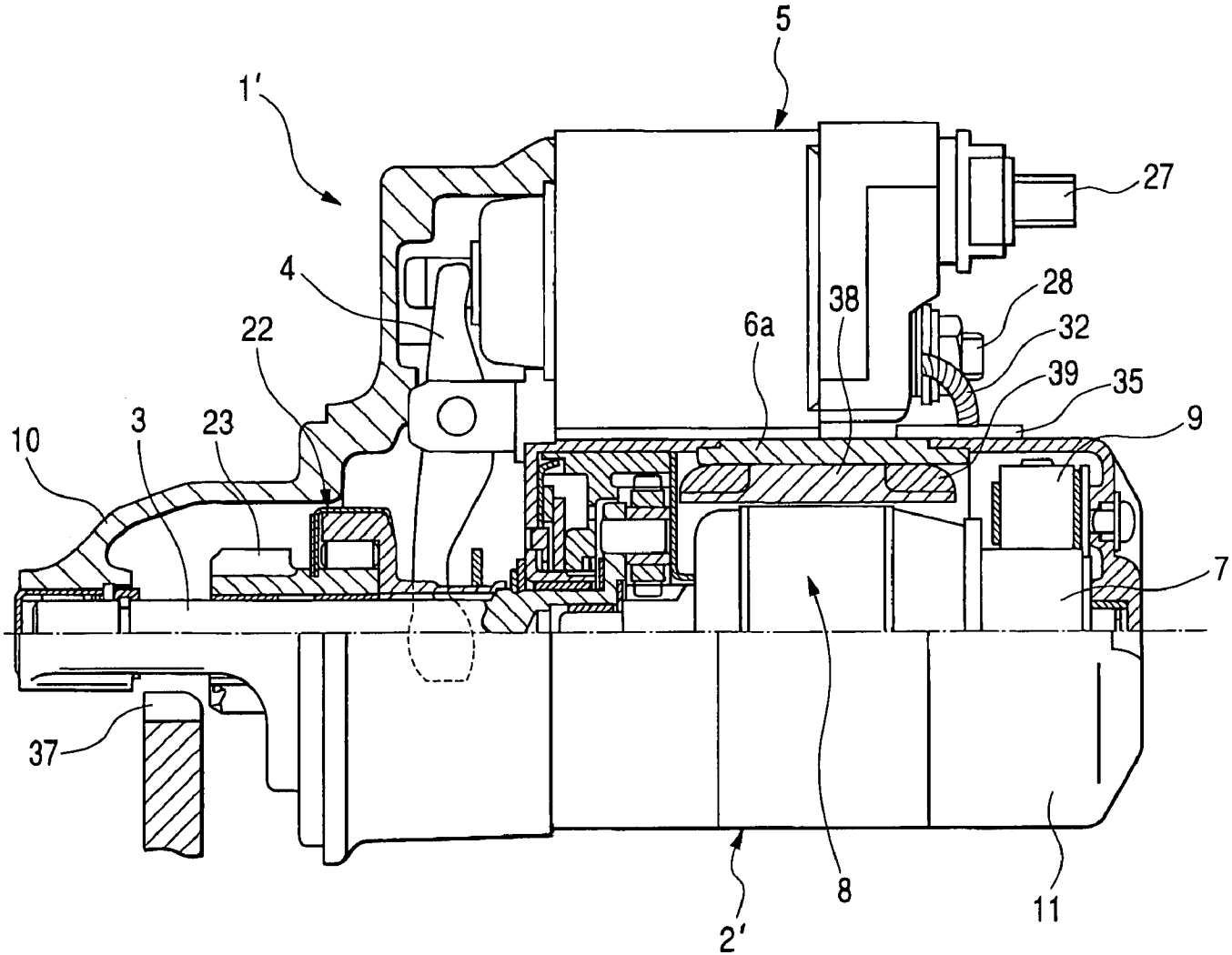
FIG. 7 is a half cross-sectional view showing a starter according to the third embodiment of the present invention.
Figure 8:
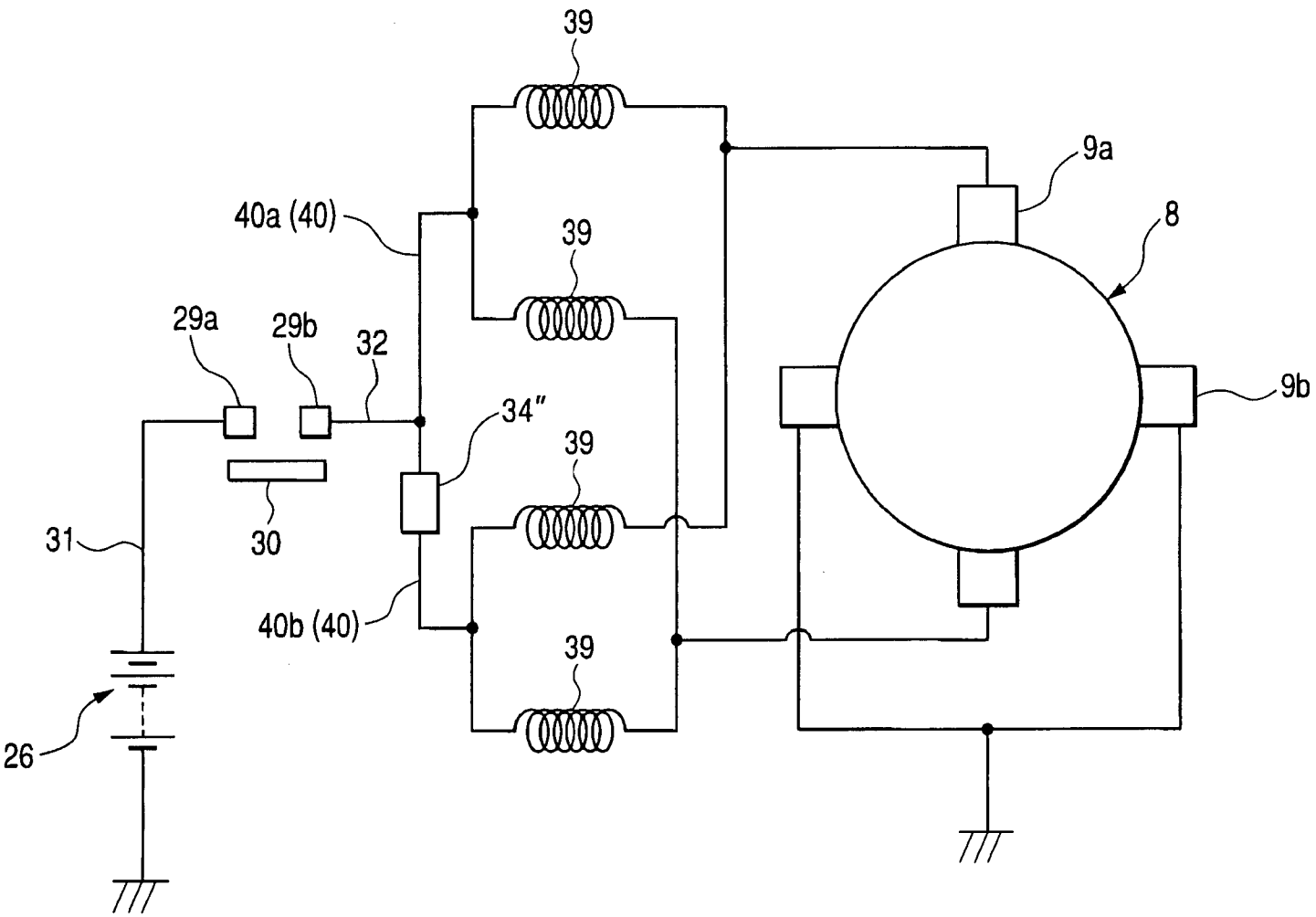
FIG. 8 is a circuit diagram of the motor circuit according to the third embodiment of the present invention.

FIG. 6 shows in plan view the internal structure of a motor 2' according to a third embodiment of the present invention, FIG. 7 shows in half cross-section a starter 1' in which the motor 2' is incorporated, and FIG. 8 shows in circuit diagram a motor circuit of the starter 1'.

The starter 1' in the third embodiment includes the motor 2' having a field system of the so-called "coil type". The starter 1' is essentially different in structure of motor internal current flow paths from the starter 1 in the first embodiment shown in FIG. 3. Other structural details of the starter 1' are substantially the same as those of the starter 1 of the first embodiment discussed previously. In the third embodiment, these component parts that are substantially the same as those previously discussed with respect to the starter 1 of the first embodiment are designated by the same reference characters, a further description thereof can be omitted.

Description given below is focused on the internal current flow paths of the motor, the form of which differentiates the third embodiment from the first embodiment.

The coil-type field system of the motor 2' comprises a yoke 6*a* forming a magnetic circuit, field poles (magnetic poles) 38 fixedly mounted to an inner periphery of the yoke 6*a*, and field coils 39 wound around the respective filed poles 38. In the third embodiment, the motor 2' comprises a four-pole motor equipped with four field poles 38 and four field coils 39.

As shown in FIG. 8, the four field coils 39 are each connected at one end to a connection bar 40 and at an opposite end to positive (or plus) brushes 9*a*.

The connection bar 40 is a rod-like metal member (made of copper, for example) forming part of the current flow paths. The connection bar 40 electrically connect together a motor lead wire 32 and the four filed coils 39 so that a start-up current supplied through the motor lead wire 32 is allowed to flow in parallel through the four filed coils 39.

As shown in FIG. 6, the connection bar 40 is composed of a first bar member 40*a* and a second bar member 40*b* separated from each other in a circumferential direction of the yoke 6*a*. The first and second bar members 40*a*, 40*b* are electrically insulated by a resin insulator 41 and they are disposed in the interior of an open end of the yoke 6*a* located adjacent an end frame (not designated).

The first bar member 40*a* is longer in length than the second bar member 40*b* and has a central portion electrically connected by welding, for example, to an inner end of the motor lead wire 32. One ends of two field coils 39 are connected in common to one end of the first bar member 40*a*. The motor lead wire 32 extends through a circular hole (not shown) of a grommet 35 attached to an end frame 11 of the motor 2'. The motor lead wire 32 has a first end portion drawn exteriorly from the end frame 12 for connection or joining with a motor terminal 28 of an electromagnetic switch 5, and a second end portion opposite the first end portion, the second end portion being disposed inside the end frame 11 (see FIG. 7).

The second bar member 40*b* is disposed on an opposite end side of the first bar member 40*a* and electrically connected to the first bar member 40*a* via an intermediate plate 34". The remaining two field coils 39 are connected, each at one and thereof, in common to one end of the second bar member 40*b*.

The intermediate plate 34" has a fuse function in the same manner as the one 34 shown in the first embodiment. Thus, when the motor circuit is subjected to a thermal load excessively larger than that in normal use, the intermediate plate 34" will undergo melting to cutoff or break the motor circuit. The intermediate plate 34" is made of iron and, as shown in FIG. 6, it is gently curved or bent into an arcuate shape. The intermediate plate 34" has two arcuate cutout recesses (not designated) formed in central portions of opposite longitudinal sides of the intermediate plate 34". The intermediate plate 34" has one end electrically connected by welding to the other end of the first bar member 40*a* and an opposite end electrically connected by welding to the other end of the second bar member 40*b*. A surface of the intermediate plate 34" is treated with a metal of lower melting point through a tinning process, for example. By thus treating the surface of the intermediate plate 34", it is possible to secure a desired welding strength between the intermediate plate 34" and the first and second bar members 40*a*, 40*b*.

The opposite end portions of the intermediate plate 34" are so configured as to posses a surface area and a cross-sectional area that are large enough to facilitate smooth and easy joining of the intermediate plate 34" and the first and second bar members 40*a*, 40*b* and to insure a desired welding strength between the intermediate plate 34" and the first and second bar members 40*a*, 40*b*. As a result of forming the arcuate cutout recesses on its opposite longitudinal sides, the intermediate plate 34" has a restricted portion 34*e* with reduced cross-section located substantially at a longitudinal center of the arcuate intermediate plate 34". The restricted portion 34*e* forms a melting portion where melting of a material of the intermediate plate 34" occurs when the motor circuit is subjected to a thermal load excessively larger than that in normal use.

In the starter 1' according to the third embodiment of the invention, the fuse function is assigned to the intermediate plate 34" made of iron having a larger electric resistance than copper. When a thermal load excessively larger than that in normal use occurs in the motor circuit, the iron intermediate plate 34" can reliably undergo melting earlier than the motor lead wire 32 and brush lead wires 33 connected to the opposite ends of the intermediate plate 34".

Additionally, since the thermal conductivity of the iron is about one-fifth of that of the copper, it is possible to suppress transmission of heat from the intermediate plate 34" being melting to the connection bar 40 and thence to the motor lead wire 32 connected to the connection bar 40 (particularly the first bar member 40*a* of the connection bar 40). By thus reducing the heat transmission, it is possible to protect the grommet 35 from the effect of high temperatures even though the grommet 35 supports the motor lead wire 32.

Furthermore, by virtue of the fuse function assigned to the intermediate plate 34" made of iron with higher electric resistance than the motor lead wire 32, the motor lead wire 32 and the connection bar 40 do not undergo reduction in mechanical strength which may occur when the fuse function is assigned to the motor lead wire 32 or the connection bar 40 by reducing the cross-sectional area of the motor read wire 32 or the connection bar 40. The starter 1' is thus increased in reliability.

Moreover, since iron used as a material for the intermediate plate 34" is readily available at a low cost, it is possible to reduce the production cost of the intermediate plate 34". Furthermore, the intermediate plate 34" is easy to manufacture because it can be produced through press-forming operations.

The intermediate plate 34" has two arcuate cutout recesses (not designated) arranged to provide a single restricted portion 34*e* with reduced cross-section located at a longitudinal central portion of the intermediate plate 34". The thus provided restricted portion 34*e* forms an intermediate or central part of a current flow path extending between one end of the intermediate plate 34" connected to the first bar member 40*a* and the other end of the intermediate plate 34" connected to the second bar member 40*b*. By thus arranging the restricted portion 34*e*, when a thermal load excessively larger than that in normal use occurs in the motor circuit, melting of the intermediate plate 34" will occur only at the restricted portion 34*e*. This will improve the reliability concerning the melting position and the melting time of the intermediate plate 34".

Furthermore, the surface treatment such as tinning effected on a surface of the intermediate plate 34" improves weldability of the intermediate plate 34" relative to the first and second bar members 40*a*, 40*b*. Joint portions formed by welding can withstand vibrations during travel of the motor vehicle without causing accidental separation. The separation-free joint portions also contribute to the improvement in the reliability of the fuse function.

In the starter 1 of the first embodiment, the motor lead wire 32 and the brush lead wires 33 are connected to the intermediate plate 34. This arrangement necessarily limits the position of the intermediate plate 34. In case of the starter 1" of the third embodiment, however, the intermediate plate 34" can be placed on any part of the connection bar 40. More specifically, the position of the intermediate plate 34" can be changed depending on a position where the connection bar 40 is separated into first and second bar members 40*a*, 40*b*. Thus, the starter 1' has a higher degree of freedom in arranging or placing the intermediate plate 34". The size and shape of the intermediate plate 34" are not greatly limited by special requirements. Rather, the intermediate plate 34" is allowed to posses any size and configuration that is suitable for an intermediate plate having a fuse function.

Figure 9:
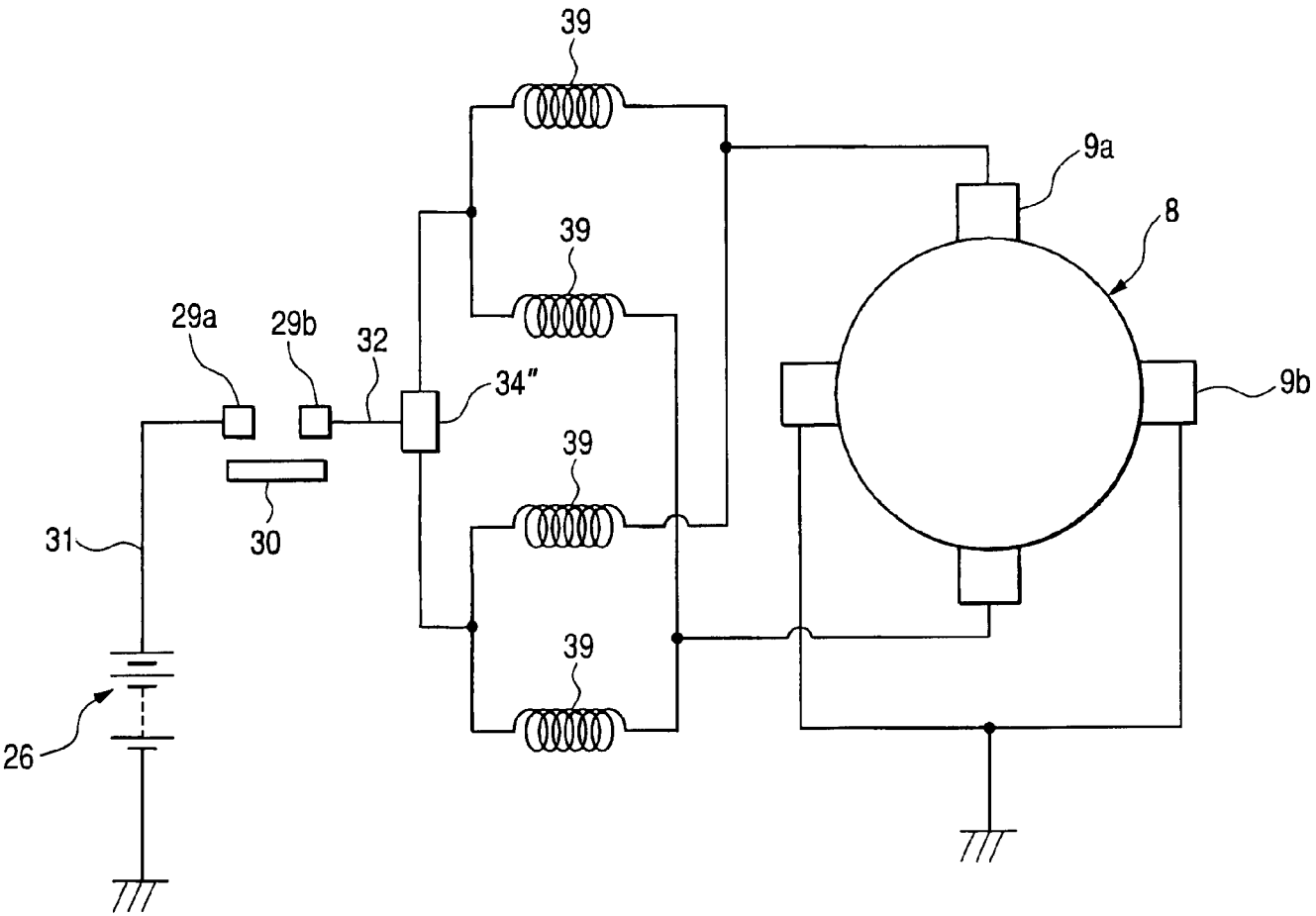
FIGS. 9 to 11 are views similar to FIG. 8, but showing alternative arrangements of an intermediate member or plate according to modifications of the present invention.

In the first embodiment shown in FIGS. 1 to 4, the motor 2 has a so-called "magnet-type" field system using permanent magnets 6*b*. The present invention can be also applied to a motor having a "coil-type" field system equipped with field coils as in the case of the motor 2' according to the third embodiment shown in FIGS. 6 to 8. In the latter case, if field coils 39 are disposed on a low potential side (ground or earth side) of the armature 8, positive brush lead wires 33 are connected to the intermediate plate 34 in the same manner as the first embodiment. Alternatively, if the field coils 39 are disposed on a high potential side (battery side) of the armature 8, one end of each field coil 39 remote from the brush is connected to the intermediate plate 34" as shown in FIG. 9.

Figure 10:
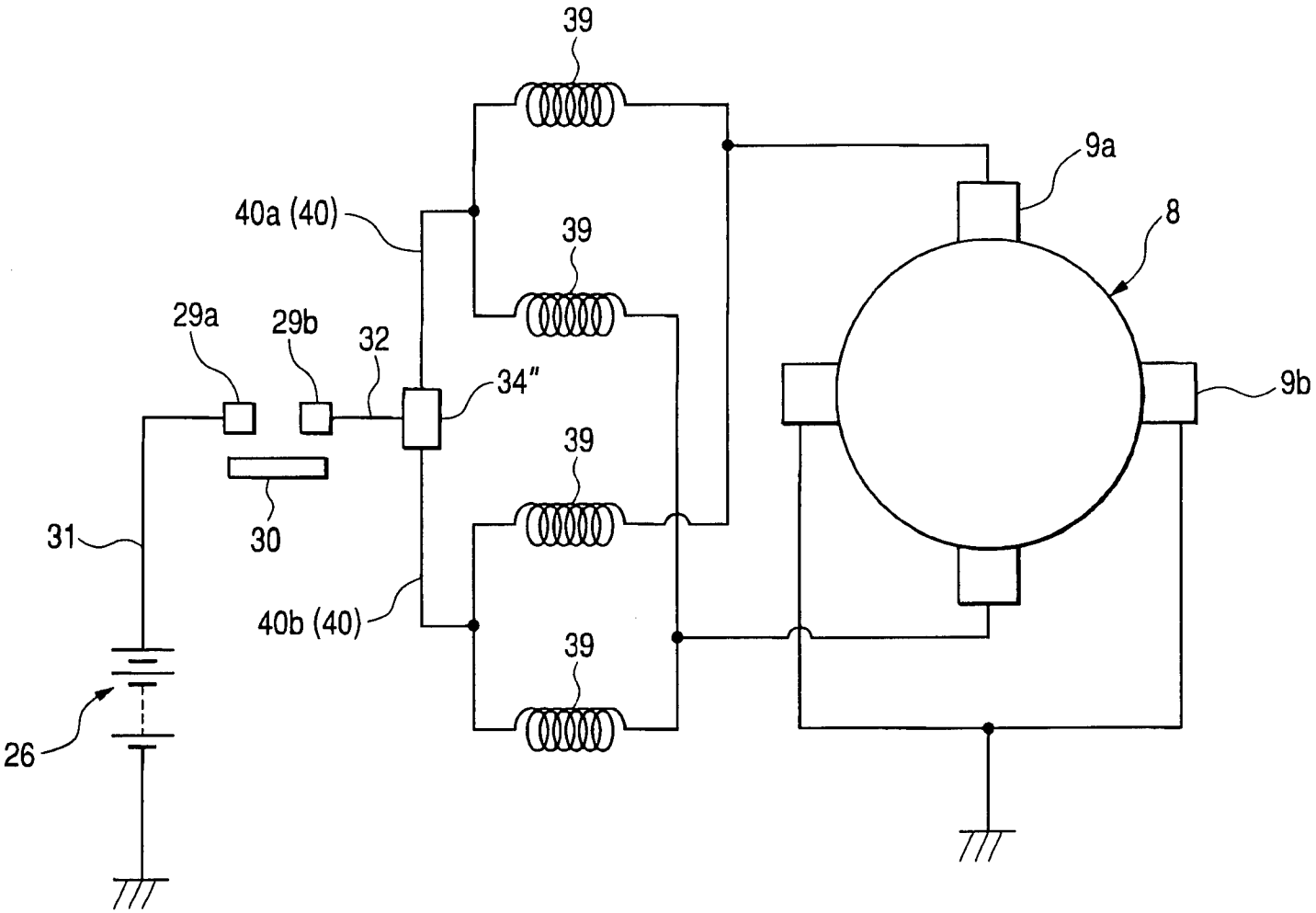
Figure 11:
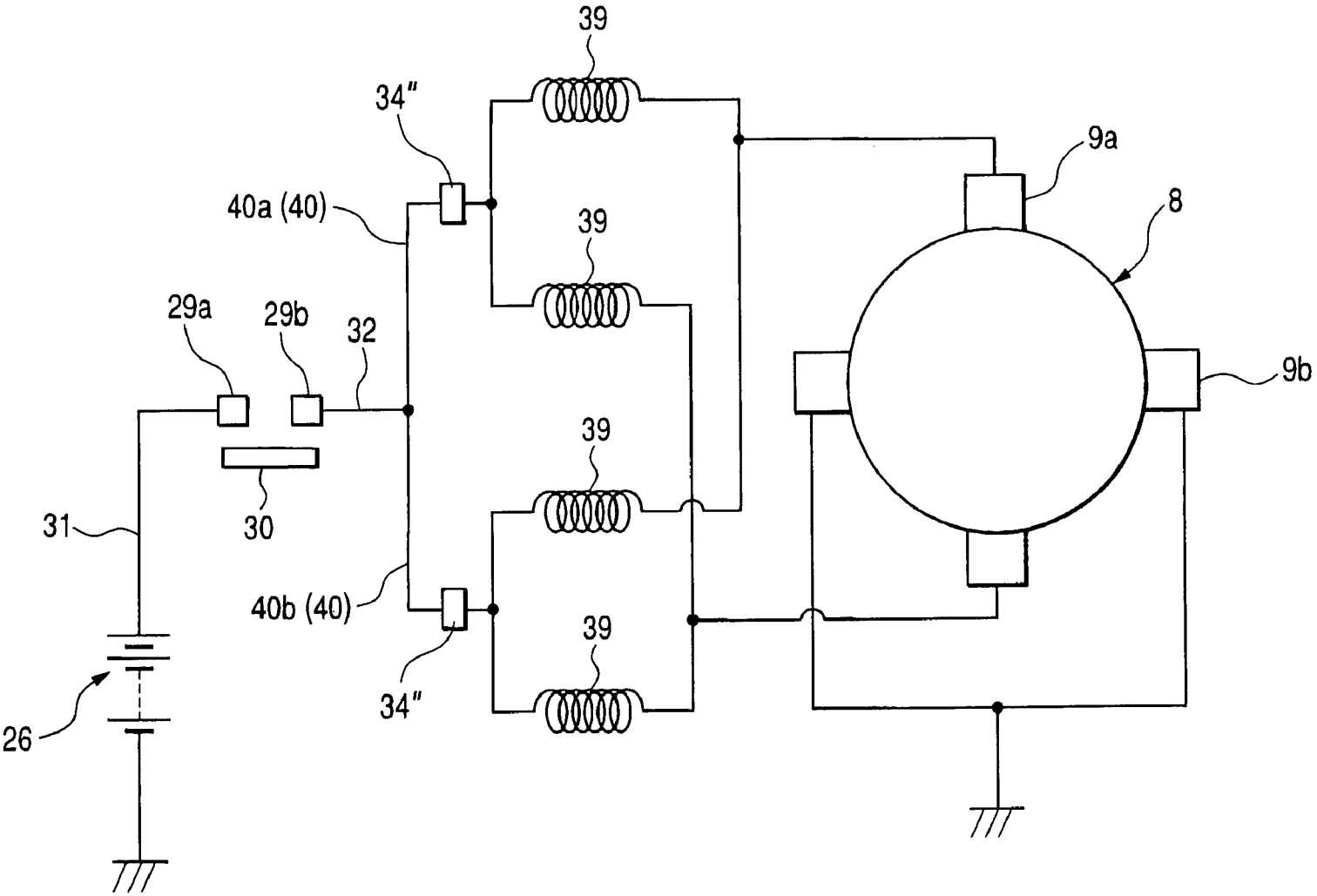

In the third embodiment shown in FIGS. 6 to 8, the connection bar 40 is separated into two parts, i.e., a first bar member 40*a* and a second bar member 40*b*, and the intermediate plate 34" is disposed between the first and second bar members 40*a*, 40*b*. In an alternative arrangement, the intermediate plate 34" may be disposed between the motor lead wire 32 and the connection bar 40 so that the motor lead wire 32 and the connection bar 40 are electrically connected together via the intermediate plate 34", as shown in FIG. 10. In another alternative arrangement shown in FIG. 11, two intermediate plates 34" are provided, each intermediate plate 34" being disposed between the connection bar 40 and two parallel disposed field coils 39 so that the connection bar 40 and the field coils 39 are electrically connected together via the intermediate plate 34".

The starter 1' of the third embodiment has a "coil-type" field system including field coils 39 and a connection bar 40 disposed inside the motor 2'. The motor 2' may be equipped with a "magnet-type" field system including permanent magnets as in the case of the first embodiment. In this instance, the connection bar 40 is disposed between the motor lead wire 32 and the positive brush lead wires 33 so that the motor lead wire 32 and the positive brush lead wires 33 are electrically connected together via the connection bar 40. In case of the motor having a "magnet-type" field system, the intermediate plate 34 may be disposed in a position selected among from three alternative arrangements. In the first arrangement, the intermediate plate 34" is disposed in an intermediate portion of the connection bar 40. In the second arrangement, the intermediate plate 34" is between the motor lead wire 32 and the connection bar 40. In the third arrangement, the intermediate plate 34" is disposed between the connection bar 40 and the brush lead wires 33.

In the first to third embodiments described above, intermediate plates 34, 34', 34" made of iron are used. According to the invention, iron may be replaced by any other materials provided that they have a larger electric resistance than copper and a smaller thermal conductivity than the copper. Typical examples of such materials include aluminum and tin.

The shape of the intermediate member should by no means be limited to a plate-like shape as in the illustrated embodiments. Rather, the intermediate member may take the form of a tube, a rod or a block. In either case, the intermediate member has a restricted portion 34*e* with reduced cross-section serving as a fuse.

As a further modification according to the present invention, the connection bar 40 incorporated in the "coil-type" starter may be made of iron so that the connection bar 40 itself has a fuse function.

Figure 12:
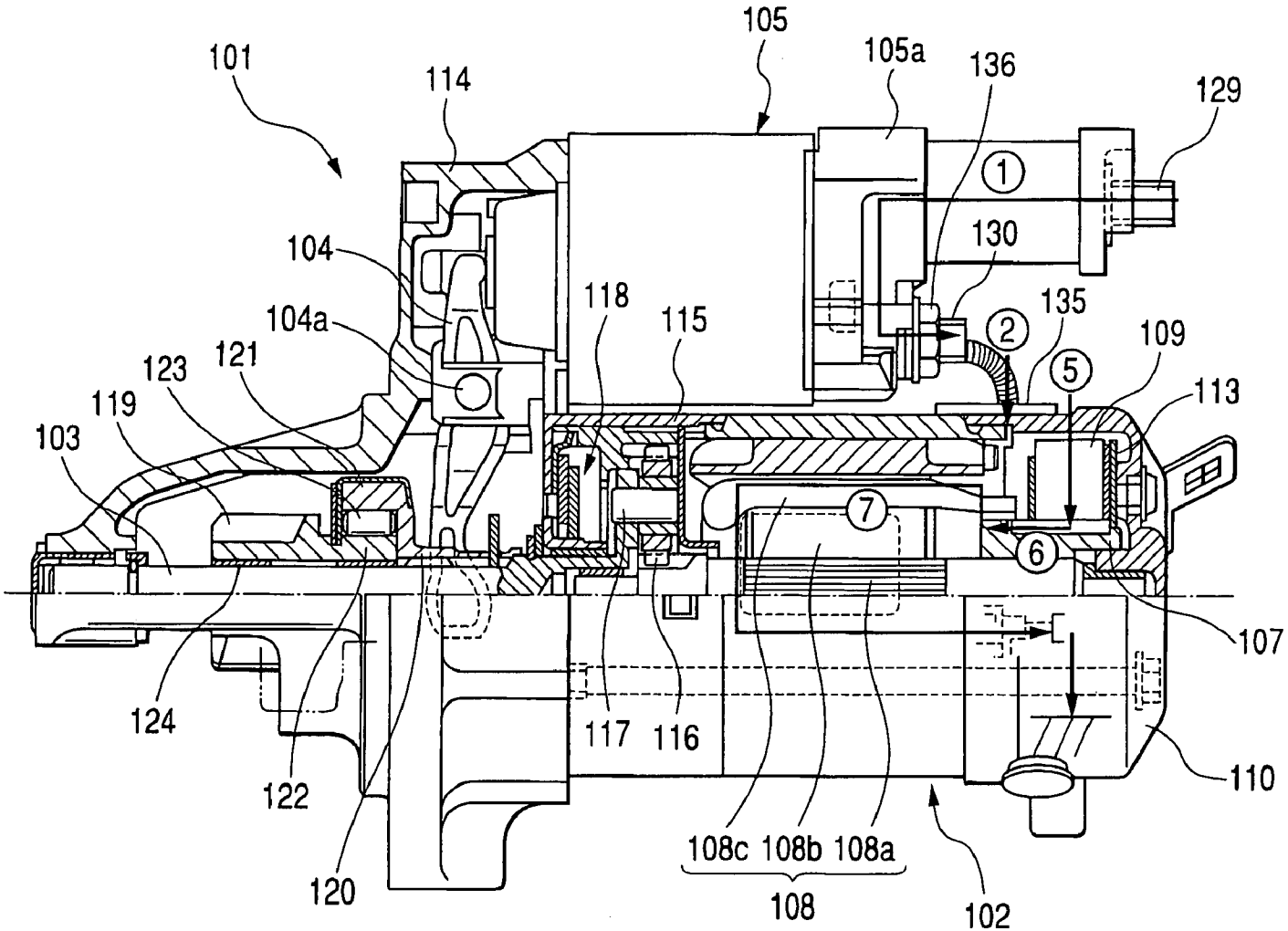
FIG. 12 a half cross-sectional view of a starter according to the fourth embodiment of the present invention.
Figure 15:
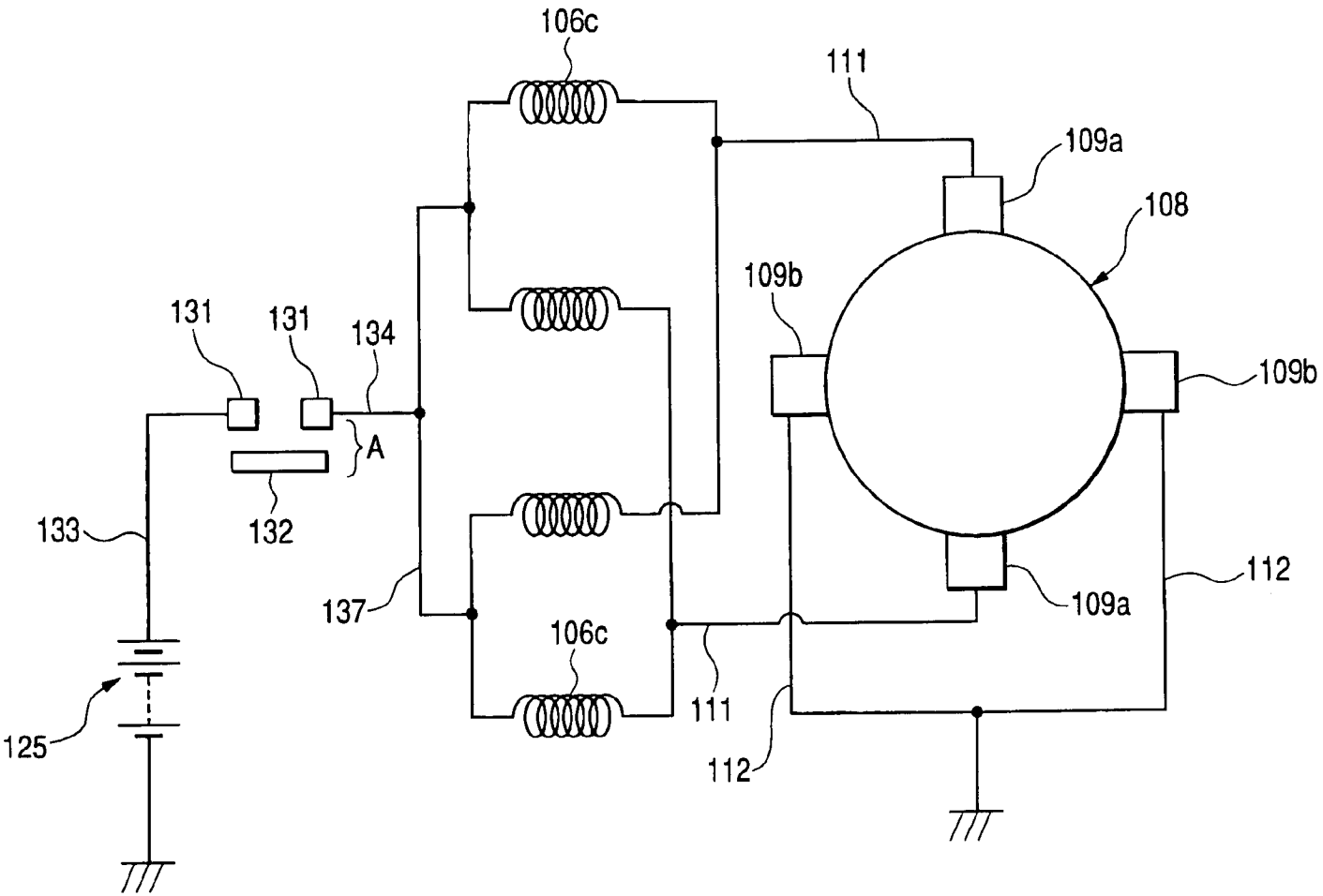
FIG. 15 is a circuit diagram of a motor circuit of the starter shown in FIG. 12.

FIG. 12 shows in half cross-section a starter 101 according to a fourth embodiment of the present invention. The starter 101 generally comprises a motor 102 for generating a rotational force, an output shaft 103 driven in rotation by the motor 102, a pinion displacing member (described later) mounted on the output shaft 103, and an electromagnetic switch 105 doubles in function to force the pinion displacing member in a direction (leftward in FIG. 12) away from the motor 102 via a shift lever 104 and to open and close a contact means A (described later) provided in a motor circuit (FIG. 15).

The motor 102 comprises a direct-current (dc) motor known per se and includes a field system 106 (FIG. 13A) for producing a magnetic flux, an armature 108 having a commutator 107, and brushes 109 disposed on the commutator 107.

Figure 13B:
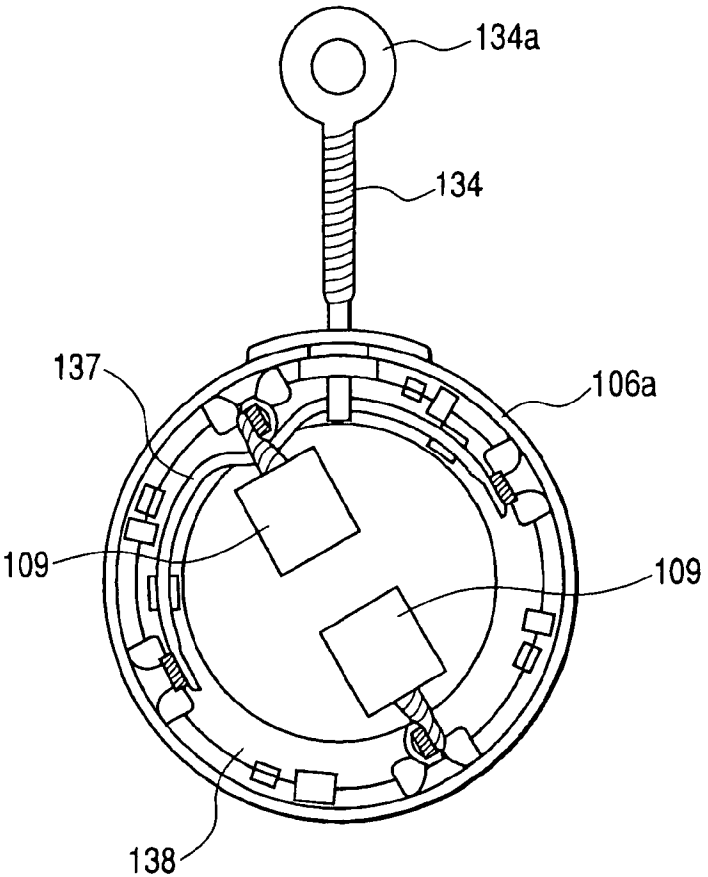
FIG. 13B is an end view of FIG. 13A.
Figure 13A:
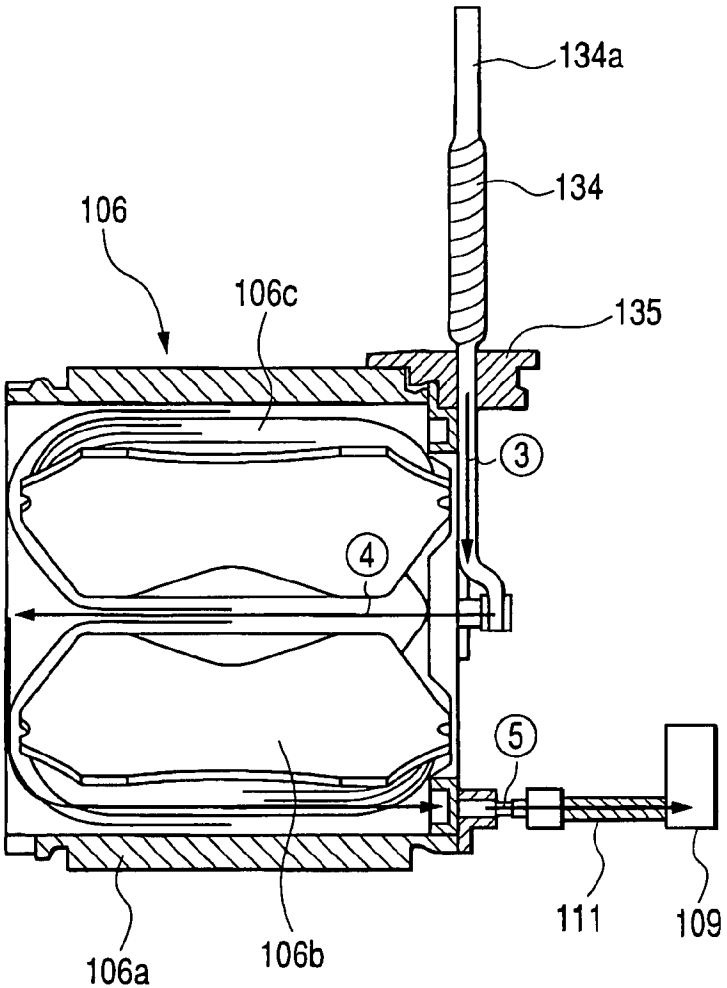
FIG. 13A is a cross-sectional view of a field system of the starter of FIG. 12.

As shown in FIGS. 13A and 13B, the field system 106 is composed of a hollow cylindrical yoke 106*a* forming a magnetic circuit and serving also as a frame of the motor 102, a plurality of field poles 106*b* fixed to an inner periphery of the cylindrical yoke 106*a*, and a plurality of field coils 106*c* wound around the respective field poles 106*b*. The field coils 106*c* comprise a conduction cut-off means (described later) according to the invention. The motor 102 used in the starter 101 of this embodiment is, as shown in FIG. 15, a four-pole motor having four field poles 106*b* and four field coils 106*c*.

The armature 108 has a rotating shaft 108*a*, an armature core 108*b* fixedly mounted on the rotating shaft 108*a*, and armature coils 108*c* wound around the armature core 108*b*. The rotating shaft 108*a* has a first end (left end in FIG. 12) inserted in and rotatably supported by a cylindrical portion at a motor side end (right end in FIG. 12) of the output shaft 103 for rotation relative to the output shaft 103. A second end opposite the first end of the rotating shaft 108 is rotatably supported by an end frame 110 that covers a rear portion (right end portion in FIG. 12) of the motor 102.

The commutator 107 is composed of a plurality of segments electrically insulated from one another and arranged to form a cylinder fixedly mounted on a rear end portion (right end portion in FIG. 12) of the rotating shaft 108*a*. Each of the segments of the armature 107 is electrically and mechanically connected to a respective one of plural armature coils 108*b* of the armature 108.

The brushes 109, as shown in FIG. 15, are composed of two positive brushes 109*a* connected via respective pigtails 111 to the field coils 106*c*, and two negative brushes 109*b* connected via respective pigtails 112 to the ground or earth. Each of the brushes 109*a*, 109*b* is held in a brush holder 103 (FIG. 12) and disposed on an outer periphery of the commutator 107 such that each brush 109*a*, 109*b* is held in contact with an outer peripheral surface of the commutator 107 under the force of a brush spring (not shown).

The output shaft 103 is disposed in coaxial relation to the rotating shaft 108*a* via a speed reducer (described later). The output shaft 103 has one end (left end in FIG. 12) rotatably supported by a front housing 110 and an opposite end rotatably supported by a center case 115.

The speed reducer comprises a known planetary gear mechanism constructed to reduce a rotational speed of the armature 108 to a revolution speed of a planetary gear 116. Rotation (revolving motion) of the planetary gear 116 is transmitted to the output shaft 103 via a gear shaft 117 on which the planetary gear 116 is supported.

The center case 115 covers an outer periphery of the speed reducer and is disposed between the front housing 114 and the yoke 106*a*. There is disposed between the center case 115 and the speed reducer a shock-absorbing device of the slide plate type that operates to absorb an excess torque when the speed reducer is subjected to an excessively large torque.

The pinion-displacing member is comprised of a one-way clutch (described later) and a pinion gear 119 for transmitting rotational force of the motor 102 to a ring gear (not shown) of an engine.

The one-way clutch is provided for transmitting rotation of the output shaft 103 to the pinion gear 119. To this end, the one-way clutch is composed of a spline tube 120 connected via helical spline engagement with the output shaft 103, an outer race 121 formed integrally with the spline tube 120, an inner race 122 disposed inwardly of the outer race 121, and rollers 123 disposed in a wedge-shaped space defined between the outer and inner races 121, 122.

The pinion gear 119 is disposed on a side (left side in FIG. 12) of the inner race 122 located opposite the motor 102. The pinion gear 119 is formed integrally with the inner race 122 of the one-way clutch and supported rotatably on the output shaft 103 via a bearing 124.

Figure 14:
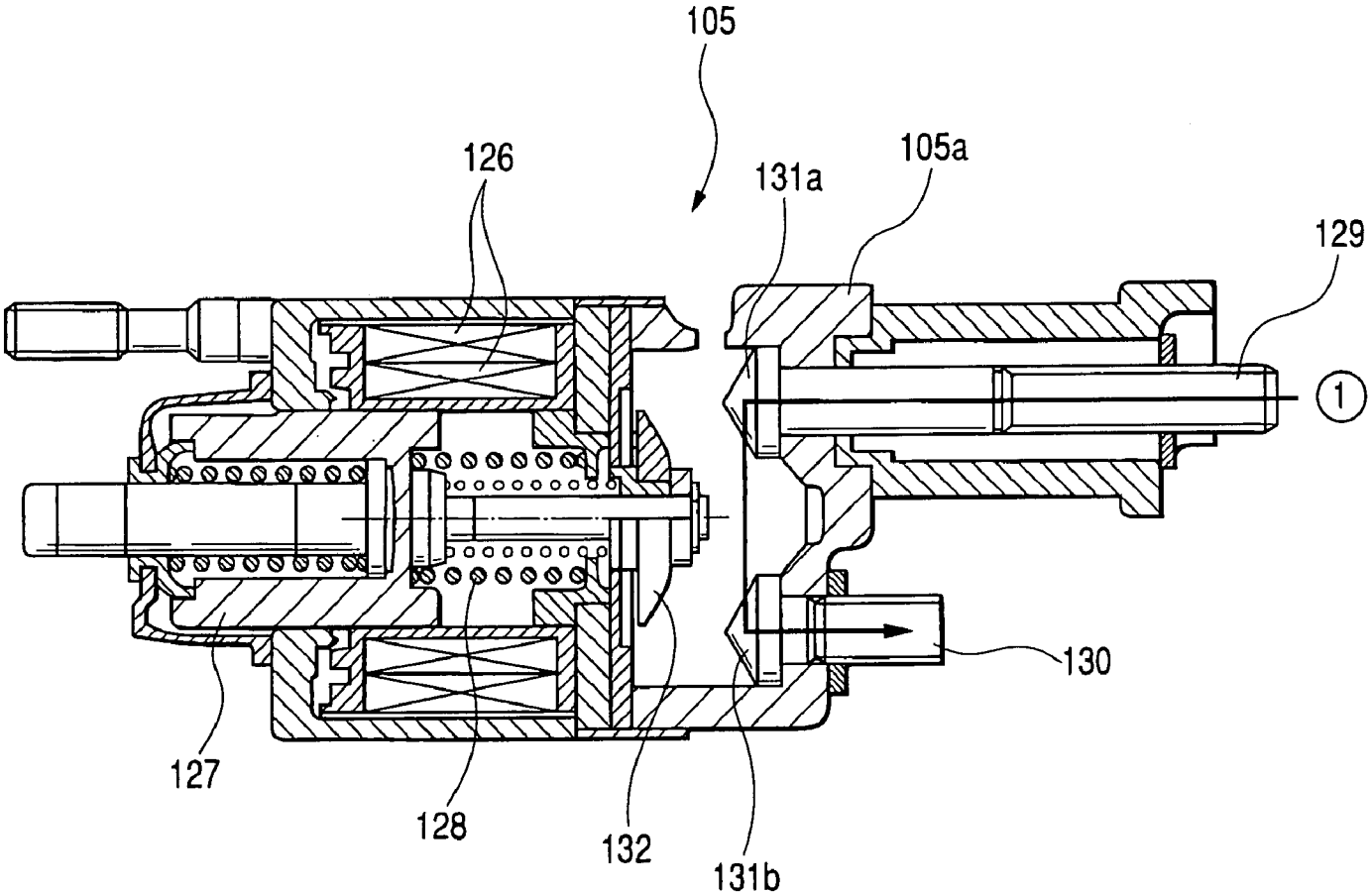
FIG. 14 is a cross-sectional view of an electromagnetic switch of the starter shown in FIG. 12.

The electromagnetic switch 105, as shown in FIG. 14, comprises an exciting coil 126 generating a magnetic force when energized with a current from a battery 125 upon closing operation of a start switch (not shown), a plunger 127 inserted in the exciting coil 126 for linear reciprocating movement such that when the exciting coil 126 is energized, the plunger 127 is displaced rightward in FIG. 14 due to attraction caused by a magnetic force generated by the exciting coil 126, and a return spring 128 urging the plunger 127 leftward in FIG. 14 so that when the exciting coil 126 is de-energized, the plunger 127 returns to its original position shown in FIG. 14 by the force of the return spring 128.

The shift lever 104 connects the plunger 127 of the electromagnetic switch 105 to the spline tube 120 of the one-way clutch. The shift lever 104 is pivotally movable about its supporting point 104*a* so that a motion of the plunger 127 can be transmitted to the pinion-displacing member.

The contact means A comprises a pair of fixed contacts 131 (131*a*, 131*b* shown in FIG. 14) connected via two external terminals 129, 130 to the motor circuit (FIG. 15), and a movable contact 132 linked in motion with the movement of the plunger 127 (or movable in unison with the plunger 127). When the movable contact 132 is in contact with the fixed contacts 131 to make or complete an electrical connection between the fixed contacts 131 together, the contact means A is in a closed state. Alternatively, the contact means A is in an open state when the movable contact 132 is out of contact with the fixed contacts 131 to break the electrical connection between the fixed contacts 131.

The external terminals 129, 130 comprise a battery terminal 129 electrically and mechanically connected to one fixed contact 131*a* (FIG. 14), and a motor terminal 130 electrically and mechanically connected to the other contact 131*b* (FIG. 14). The battery terminal 129 and the motor terminal 130 are both fixedly mounted to a contact cover 105*a* of the electromagnetic switch 105.

The battery terminal 129 has a threaded screw portion (not designated) projecting outwardly from the contact cover 105*a* for connection with a battery cable 133 (FIG. 15). The motor terminal 130 also has a threaded screw portion projecting outwardly from the contact cover 105*a*, and a motor lead wire 134 is connected to the projecting threaded screw portion of the motor terminal 130.

The motor lead wire 134 extends through and held by a grommet 135 that is attached to the end frame 110. The motor lead wire 134 has a first portion disposed outside the end frame 110 and a second portion disposed inside the end frame 100. The first end portion of the motor lead wire 134 has a ring-like terminal part 134*a* (FIG. 13) formed at a distal end thereof opposite the grommet 135. The terminal part 134*a* is fitted around the threaded screw portion of the motor terminal 130 and firmly secured to the motor terminal 130 by a nut 135 (FIG. 3). The second end portion of the motor lead wire 134 is introduced through the grommet 135 into the interior of the end frame 110 and is welded, at an end remote from the grommet 135, to connection bar 137 made of copper (FIG. 15).

The connection bar 137 is a component part forming a part of the motor circuit shown in FIG. 15 and is connected with respective ends of the field coils 106*c* remote from the brushes 109. The connector bar 137 thus electrically connects the motor lead wire 134 and the respective field oils 106*c*. The connection bar 137, as shown in FIGS. 13A and 13B, is held in an electrically insulated condition by a resin insulator 138 assembled in an opening of the yoke 106*a* adjacent the end frame 110.

The motor circuit forms a current flow path inside the starter 101 for the passage therethrough of a start-up current. As shown in FIG. 15, the motor circuit is comprised of plural circuit parts including the battery terminal 129, the contact means A (fixed contacts 131 and movable contact 132), the motor terminal 130, the motor lead wire 134, the connection bar 137, the field coils 106*c*, the positive brush pigtails 111, the positive brushes 109, the armature 108 (armature coils 108*c* and commutator 107), the negative brushes 109, and the negative brush pigtails 112. When the contact means A is closed, the start-up current is allowed to flow through the plural circuit parts in succession, as indicated by the arrows sown in FIGS. 12 to 14. In FIGS. 12 to 14, numeric characters shown in circles represent the order of passage of the start-up current through the motor circuit.

Description will be next given of a conduction cut-off function of the present invention.

The conduction cut-off function is a function of cutting off or breaking the motor circuit by melting a particular circuit part selected from among the plural circuit parts forming the motor circuit when the motor circuit is subjected to a thermal load excessively larger than that in normal use. Thus, the conduction cut-of function is equivalent to the fuse function used herein with respect to the first to third embodiments of the present invention.

The conduction cut-off function is assigned to the particular circuit part by reducing a cross-sectional area of the particular circuit part over a length not less than one-half of the entire length of the particular circuit part. In the fourth embodiment, the particular circuit part is formed by the field coils 106*c*, and a copper wire used in the field coils 106*c* has a smaller diameter than the copper wire used in a conventional field coils. Stated more specifically, the copper wire used in the fourth embodiment has a cross-sectional area, which is about 90 percent of the cross-sectional area of the copper wire used in the conventional field coil.

In general, the plural circuit parts together forming the motor circuit are designed to have respective cross-sectional areas so determined as to substantially equalize current densities of the plural circuit parts. For example, the cross-sectional area of the motor lead wire 134 connected in series with the motor terminal 130 is set to be a reference value, and cross-sectional areas of the remaining circuit parts are determined depending on the number of a parallel circuit formed with respect to the motor lead wire 134, as shown in Table 1 below.

TABLE 1

| Circuit Part | Cross-sectional Area | Number of Parallel Circuit | Current Density |
|---|---|---|---|
| Motor lead wire | a | 1 | α |
| Connection bar | a/2 | 2 | α |
| Field coils | a/4 | 4 | α |
| Brush pigtails | a/2 | 2 | α |
| Armature coils | a/2 | 2 | α |

As shown in Table 1, the field coils 106*c* used in the four-pole motor form four parallel circuits so that the cross-sectional area of the field coils 106*c* is about one-fourth of the cross-sectional area "a" of the motor lead wire 134. According to the invention, however, since the field coils 106*c* form the conduction cut-out means capable of performing the conduction cut-out function discussed above, the cross-sectional area of the field coils 106*c* is reduced about 10 percent from the cross-sectional area of the conventional field coils which is generally set to be one-fourth of the cross-sectional area of the motor lead wire 134. By thus reducing the cross-sectional area, the field coils 106*c* have a larger current density than the remaining circuit parts of the motor circuit.

Description will be next given of operation of the starter 101.

At first, the non-illustrated start switch is manually turned on or closed whereupon the exciting coil 126 of the electromagnetic switch 105 is energized to attract or pull the plunger 127 rightward in FIG. 14 into the exciting coil 126. The rightward movement of the plunger 127 causes the shift lever 104 to turn clockwise in FIG. 12 about the support point 104*a*, thus forcing the pinion-displacing member to move leftward on and along the output shaft 103. With this leftward movement of the pinion-displacing member, the pinion gear 119 comes in abutment with an end face of the ring gear (not shown but identical to one 37 shown in FIG. 3) of the motor vehicle engine with which the starter 101 is associated. Upon abutment, leftward movement of the pinion gear 119 is interrupted.

The rightward movement of the plunger 127 also causes the contact means A to close whereupon the armature 108 is energized and thus begins to rotate. Rotation of the armature 108 is reduced by the speed reducer (planetary gear mechanism) and thereafter transmitted to the output shaft 103.

The output shaft 103 is thus rotated at a reduced speed. Rotation of the output shaft 103 is transmitted via the one-way clutch to the pinion gear 119. Upon rotation, the pinion gear 119 first moves angularly or turns to a position where the pinion gear 119 is able to come in meshing engagement with the ring gear. After mutual meshing engagement is completed between the pinion gear 119 and the ring gear, a rotational force is transmitted from the pinion gear 119 to the ring gear, thereby cranking the engine.

After the engine is started up, the start switch is turned off or opened whereupon the exiting coil 126 is de-energized to thereby allow the plunger 127 to move leftward in FIG. 14 to its original position by the force of the return spring 128. With this leftward movement of the plunger 127, the contact means A is opened to thereby de-energize the motor 102, and the pinion displacing member is displaced via the shift lever 4 in a rightward direction in FIG. 12 along the output shaft 103 until the pinion displacing member assumes the original standby position shown in FIG. 12.

During the operation discussed above, if a return failure of the start switch 25 occurs or if, due to some reason, the motor 102 is continuously energized under a no-load condition, the armature coils 108*c* may undergo dielectric breakdown to cause a short-circuit between coils. Under such abnormal conditions, the motor 102 is continuously energized with a large current of several hundred amperes supplied from the battery 125 with the result that the motor circuit is subjected to a thermal load excessively larger than that in normal use. During that time, owing to its cross-sectional area reduced to possess a larger current density than the remaining circuit parts of the motor circuit, the field coils 106*c* accept passage of a larger current than the other circuit parts and hence generate a large amount of Joule heat.

As a consequence, the field coils 106*c* as a whole generate heat and eventually melting or fusion occurs at a portion of the field coils 106*c* where the current density is particularly high. Upon melting, the motor circuit is cut-off, so that continued energization of the motor 102 can be avoided.

Figure 16:
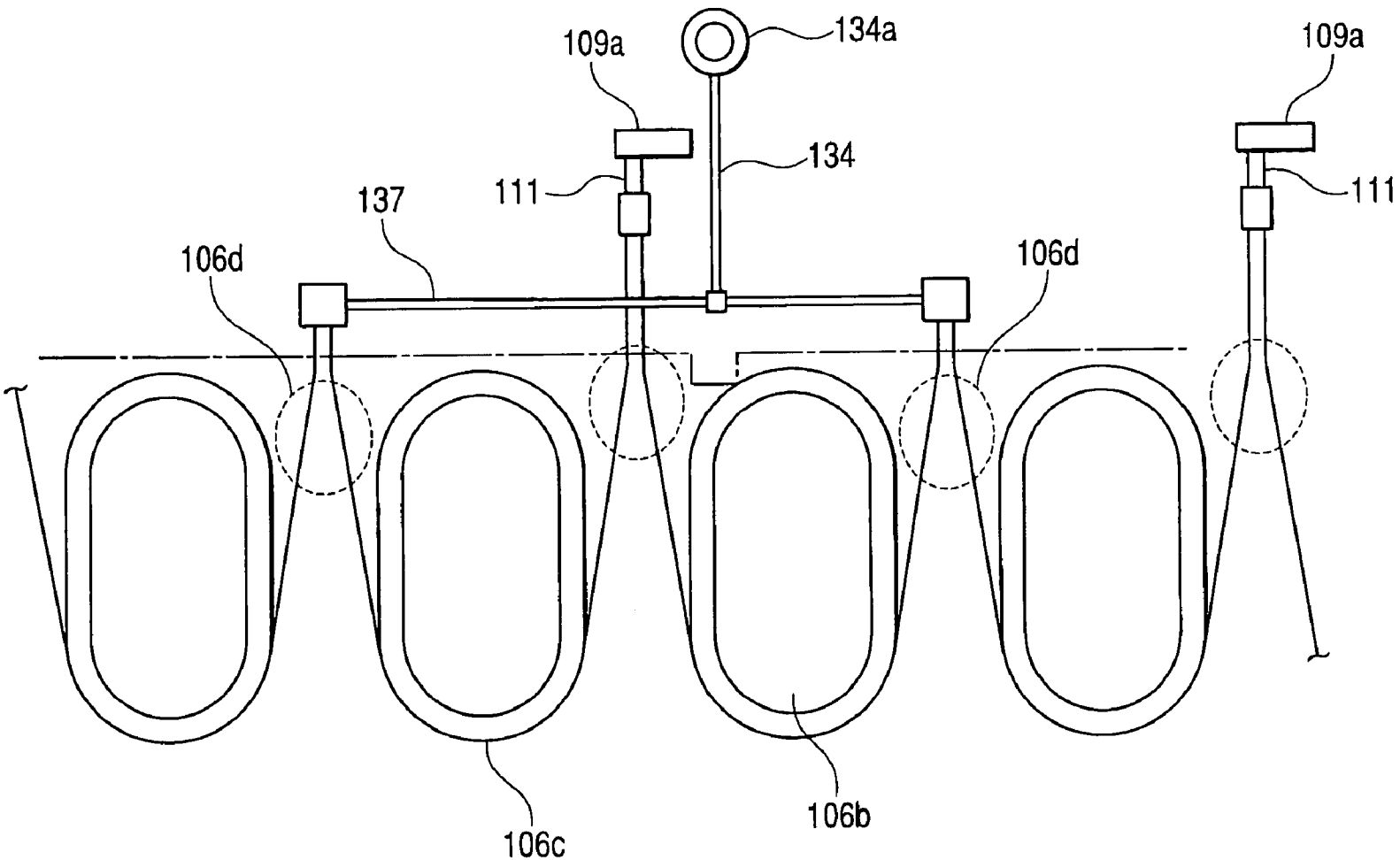
FIG. 16 is a schematic circuit diagram showing the position of melting portions of the field coils according to the fourth embodiment of the invention.

In this instance, since the field coils each have several turns (four turns, for example) around a single field pole 106*b*, if adjacent coils are short-circuited due to dielectric breakdown of insulating coating layers, the current density of the short-circuited part will decrease with the result that melting hardly occurs at a part of the field coils 106*c* wound around the field poles 106*b*. In practice, melting is likely to occur at end portions 106*d* (winding start end portion and winding finish end portion) of the field coils 106*c* that are drawn out from the respective field poles 106*b*, as indicated by broken-lined circles shown in FIG. 16.

As thus far explained, in the starter 101 of the fourth embodiment the field coils 106*c* are assigned to have a cut-off function by reducing the cross-sectional area throughout the length thereof. As compared to the conventional arrangements shown in JP-A 10-66311 and FR-A 2785086 where the motor lead wire is locally restricted or narrowed to have a fuse function, the cross-sectional area of the field coils 106*c* of the present invention is reduced over the entire length of the field coils 106*c* with the result that a temperature drop caused due to thermal conduction is limited to a minimum. In other words, since Joule heat generated in the field coils 106*c* is hardly released, it is possible to cause the melting to occur efficiently during a short time by using heat generated from the entire field coils 106.

Furthermore, the conduction cut-off function is performed by a part of the motor circuit, i.e., the field coils 106*c*, there is no need to provide a separate thermal fuse or a bimetal as in the manner shown in WO 00/19091, which will increase the number of parts and the cost of the starter.

Additionally, since the heat generated from the entire field coils 106*c* can be used efficiently to cause melting, there is no need to greatly reduce the cross-sectional area of the field coils 106*c*. In practice, an about 10% reduction in the cross-sectional area as compared to the conventional field coils is sufficient to carry out the prescribed conduction cut-off function. Thus, an increase in the circuit resistance caused by a reduction in the cross-sectional area can be controlled to be as small as possible, so that the output of the starter 101 does not substantially decrease.

Moreover, differing from the conventional arrangements shown in JP-A 10-66311 and FR-A 2785086 in which local stress concentration is inevitable due to the use of lead wires locally reduced in cross section, the field coils 106*c* of this embodiment is free from local stress concentration because the cross-sectional area of the field coils 106*c* is reduced over the entire length of the field coils 106*c*. Thus, reduction in the cross-sectional area does not cause a noticeable reduction in the mechanical strength of the field coils 106. The field coils 106*c* is highly resistant to a break, which would otherwise occur due to vibrations during travel of the motor vehicle. With the field coils 106 thus arranged, a highly reliable conduction cut-off function can be attained.

Additionally, the conventional arrangements shown in JP-A 10-66311 and FR-A 2785086 require a separate process to locally reduce the cross-sectional area of the lead wires. The arrangement in this fourth embodiment, as against the conventional arrangements, does not require any separate work or processing on the field coils 106. Use of a copper wire having smaller diameter than that used in the conventional field coils will suffice to provide a desired conduction cut-off function. This is also advantageous from the cost-reducing point of view.

Furthermore, since the conduction cut-off function is assigned to the field coils 106*c*, it is possible to provide a relatively large space or distance between the field coils 106 and the grommet 135. Although the grommet 135 formed from a flammable material such as rubber is readily affected by heat, owing to the presence of such a large spacing between itself and the field coils 106, it is possible to reduce the effects of a high temperature produced when the field coils undergo melting and hence to protect the grommet 135 from being damaged by heat. Moreover, the field coils 106*c* having the conduction cut-off function are disposed inside the motor 102, melting of the field coils 106*c* gives almost no thermal effect on component parts and wire-harnesses of the motor vehicle disposed around the starter 101. Thus, the motor circuit can be cut-off safely.

Although in the fourth embodiment discussed above, the field coils 106 are reduced in cross-sectional area over the entire lengths thereof, it is possible according the present invention to reduce the cross-sectional area over a length at least half (or greater than one-half of) the entire lengths of the respective field coils 106*c* to provide a desired conduction cut-off function. In this instance, since the length of the restricted portion of the field coils 106 decreases, the rate of reduction of the cross-sectional area is increased. In other words, the diameter of the field coils 106 is reduced to a greater extent than in the case of the fourth embodiment. For example, when the field coils 106*c* are reduced in cross-sectional area over half the entire lengths of the respective field coils 106*c*, the cross-sectional area of the field coils 106*c* is reduced by about 30% as compared to that of the conventional field coils.

A portion of the field coils 106 where the cross-sectional area is reduced should by no means be limited to a continuous form but may be provided discretely. For example, such portion of reduced cross-section may be formed on a winding-start end portion and a winding-finish end portion of each field coil 106*c*. This arrangement is preferable because a central portion of each field coil 106*a* that is would around one of the field poles 106*b* is unlikely to become high in temperature due to conduction of heat to the field pole 106*b* and the yoke 106*a*. The winding-start and winding-finish end portions extending from the connection bar 137 in an axial direction of the motor 2 are likely to become high in temperature and eventually undergo melting or fusion. Furthermore, such a high temperature leading to melting can be readily obtained especially at a part of the winding-start or the winding-finish end portion of the field coil 106*c*, which is held to run without continuous contact or interference with the yoke 106*a*, it is desirable to design the field coils with the assumption that melting occurs at the aforesaid part of the field coils 106.

It is preferable that the winding-start end portion and the winding-finish end portion of each field coil 106*c* are pre-tensioned or prestresserd with a tension imparted thereto. When the field coil 106*c* undergoes melting at either end portion, the fused end portion will automatically separate into two parts due to the effect of the tension imparted to the end portion. This will ensure that the motor circuit can be cut off quickly and reliably.

According to the invention, the motor lead wire 134 held by the grommet 135 made of flammable material and the connection bar 137 held by the insulator 138 made from flammable resin may be increased in cross-sectional area as compared to those of the conventional arrangement. The grommet 135 and the insulator 138, due to the flammability of the materials forming these components, may be affected by heat when the motor circuit is subjected to an excessively large thermal load.

To deal with this problem, a motor lead wire 134 having a larger cross-sectional area and a smaller current density than the conventional motor lead wire and a connection bar 137 having a larger cross-sectional area and a smaller current density than the conventional connection bar are used in combination with the field coils 106*c* having a conduction cut-off function. Stated more specifically, as shown in Table 2 below, the motor lead wire 134 has a cross-sectional area which is about 1.5 times larger than that of the conventional motor lead wire, and a current density which is about 1/1.5 of the current density of the conventional motor lead wire. Similarly, the connection bar 137 has a cross-sectional area which is about two-times larger than that of the conventional, and a current density which is about ½ smaller than that of the conventional connection bar. The remaining circuit parts of the motor circuit, i.e., the field coils 106*c*, the positive brush pigtails 111, the negative brush pigtails 112 and the armature coils 8*c* are the same in cross-sectional-area and current density as those used in the fourth embodiment described above.

TABLE 2

| Circuit Part | Cross-sectional Area | Number of Parallel Circuit | Current Density | Calorific Power |
|---|---|---|---|---|
| Motor lead wire | a × 1.5 | 1 | α/1.5 | small |
| Connection bar | a/2 × 2 | 2 | α/2 | small |
| Field coils | a/4 × 0.9 | 4 | α × 1.11 | large |
| Brush pigtails | a/2 | 2 | α | medium |
| Armature coils | a/2 | 2 | α | medium |

When the motor circuit of the foregoing configuration is subjected to an excessively large thermal load, the field coils 106*c* will undergo melting at the winding-start end portion or the winding-finish end portion thereof to thereby cutoff or break the motor circuit. Furthermore, by virtue of the reduced current densities, the motor lead wire 134 and the connection bar 137 generate less amount of heat than the conventional components with the result that the grommet 135 and the insulator 38 are protected from the effect of high temperature. The motor lead wire 134 and the connection bar 137 form a high-temperature avoidance part.

Figure 17A:
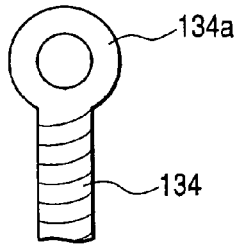
FIGS. 17A to 17C are fragmentary plan views of motor lead wires according to a fifth embodiment of the present invention.
Figure 17B:
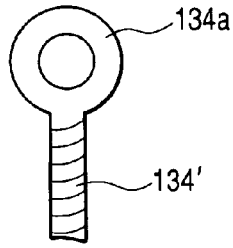
Figure 17C:
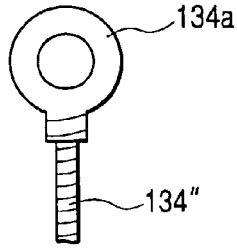
Figure 18A:
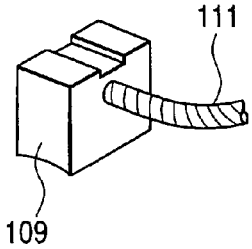
FIGS. 18A to 18C are fragmentary perspective views of brush pigtails according to a sixth embodiment of the present invention.
Figure 18B:
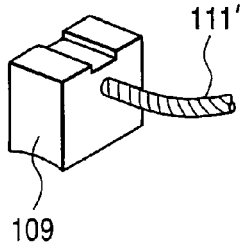
Figure 18C:
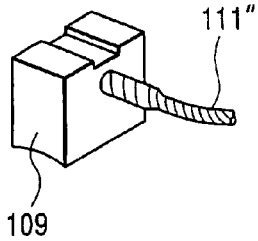

The conduction cut-off function may be assigned either to the motor lead wire 134 as shown in FIGS. 17B and 17C, or alternatively to the brush pigtail 111 as shown in FIGS. 18B and 18C.

In the first case, the motor lead wire 134 may be reduced in its cross-sectional area either over the entire length thereof as shown in FIG. 17B, or over one-half of the entire length thereof as shown in FIG. 17C.

In case of the motor lead wire 134' shown in FIG. 17B, the cross-sectional area is preferably set to be about 60% of the cross-sectional area of the conventional or ordinary motor lead wire 134 shown in FIG. 17A. This is because the entire length of the motor lead wire 134' is smaller than the entire length of each field coil 106*c*, the motor lead wire 134' requires a further reduction in the cross-sectional area as compared to the field coils 106*c* in order to obtain a necessary amount of thermal energy for melting.

The motor lead wire 134" shown in FIG. 17C has a large-diameter portion at an upper part thereof and a small-diameter portion at a lower part thereof. Given that the large-diameter portion has the same diameter as the conventional or ordinary motor lead wire 134 of FIG. 17A, the cross-sectional area of the small-diameter portion is preferably about 40% of the cross-sectional area of the ordinary motor lead wire 134.

In order to have a conduction cut-off function, the brush pigtail 111 may be reduced in its cross-sectional area either over the entire length thereof as shown in FIG. 18B, or over one-half of the entire length thereof as shown in FIG. 18C.

In case of the brush pigtail 111' shown in FIG. 18B, the cross-sectional area is preferably set to be about 60% of the cross-sectional area of the ordinary brush pigtail 111 shown in FIG. 18A for the same reason as discussed above with respect to the motor lead wire 134' of FIG. 17B.

In case of the brush pigtail 111" having a large-diameter portion at an upper part thereof and a small-diameter portion at a lower part thereof, as shown in FIG. 18C, the cross-sectional area of the small-diameter portion is preferably set to be about 40% of the cross-sectional area of the ordinary motor lead wire 134 shown in FIG. 18A.

Figure 19A:
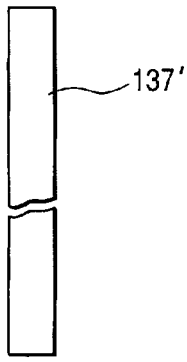
FIGS. 19A and 19B are fragmentary perspective views of connection bars according to a seventh embodiment of the present invention.
Figure 19B:
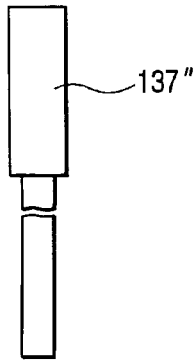
Figure 20:
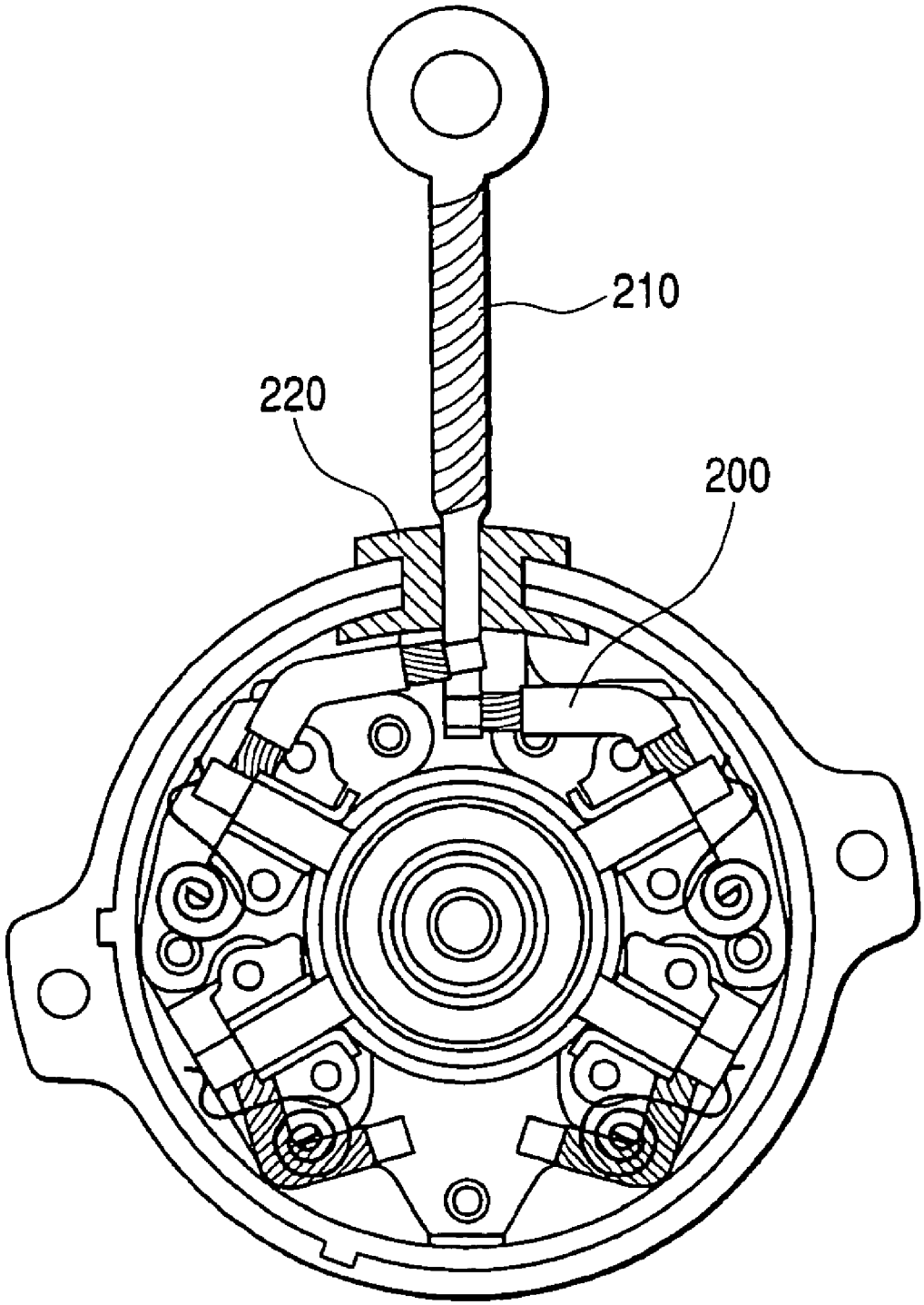
FIG. 20 (PRIOR ART)
FIG. 20 is a plan view showing a junction between a motor lead wire and a brush lead wire of a conventional starter.

FIGS. 19A and 19B show further variant of the conduction cut-off function assigned to the connection bar 137. In one variant shown in FIG. 19A, the connection bar 137' is reduced in cross-sectional area over the entire length thereof. This arrangement allows the use of a connection bar having a smaller diameter than the conventional or ordinary connection bar. In this instance, the cross-sectional area of the connection bar 137' is preferably set to be 70% of the cross-sectional area of the ordinary connector bar. This is because the connection bar has a length smaller than the field coils and larger than the motor lead wire and the brush pigtails, the reduction rate of the cross-sectional area is set to be smaller than that of the motor lead wire and the brush pigtails. In the other variant shown in FIG. 19B, the connection bar 137" is reduced in cross-sectional area over more than one-half of the entire length of the connector bar 137". In the case where a large-diameter portion of the connection bar 137" has the same diameter as the ordinary connection bar 137, the cross-sectional area of a small-diameter portion is preferably set to be about 50% of the cross-sectional area of the ordinary connection bar 137.

Although in the fourth embodiment the starter 101 takes the form of a so-called "coil-type" starter having field coils 106*c*, the present invention can effectively employed in a so-called "magnet-type" motor using permanent magnets in place of the field coils 106*c*. In case of the magnet-type starter, because of the absence of the field coils 106 and the connection bar 137, selection of a particular circuit part to assign a conduction cut-off function encounters a certain limitation. In practice, the conductor cut-off function is assigned to the brush pigtail 111 or the motor lead wire 134.

Obviously, various minor changes and modifications are possible in the light of the above teaching. It is to be understood that within the scope of the appended claims the present invention may be practiced otherwise than as specifically described.

What is claimed is:

1. A starter comprising:

an electric motor producing a rotational force when supplied with a start-up current, the electric motor having a frame and a grommet mounted on the frame;

a motor circuit for the passage therethrough of the start-up current from a battery to the electric motor; and an electromagnetic switch disposed in the motor circuit for selectively allowing and blocking flow of the start-up current through the motor circuit, wherein said motor circuit comprises:

a motor lead wire passing through the grommet and having a first end portion disposed outside the frame and connected with the electromagnetic switch and a second end portion disposed inside the frame;

a motor internal circuit disposed internally of the electric motor and forming a current flow path through which the start-up current supplied via the motor lead wire flows; and an intermediate member made of metal and electrically connected either between the motor lead wire and the motor internal circuit or to an intermediate portion of the motor internal circuit, the intermediate member having a fuse function that undergoes melting to thereby break the motor circuit when the motor circuit is subjected to a thermal load excessively larger than that in normal use.

2. A starter according to claim 1, wherein the motor internal circuit includes a connection bar forming a part of the current flow path, the connection bar being divided into a first bar member and a second bar member, and the intermediate member is disposed between the first bar member and the second bar member, the first and second bar members being electrically connected to the intermediate member.

3. A starter according to claim 1, wherein the motor internal circuit includes a connection bar forming a part of the current flow path, and the intermediate member is disposed between the connection bar and the second end portion of the motor lead wire, the connecting bar and the second end portion of the motor lead wire being electrically connected to the intermediate member.

4. A starter according to claim 1, wherein the motor internal circuit includes a connection bar forming a part of the current flow path and an internal conductor disposed on a low potential side of the connection bar, and the intermediate member is disposed between the connection bar and the internal conductor, the connecting bar and the internal conductor being electrically connected to the intermediate member.

5. A starter according to claim 1, wherein the motor internal circuit includes a brush lead wire forming a part of the current flow path and connected to a positive brush of the electric motor, and the intermediate member is disposed between the brush lead wire and the second end portion of the motor lead wire, the brush lead wire and the second end portion of the motor lead wire being electrically connected to the intermediate member.

6. A starter according to claim 1, wherein the motor internal circuit includes a field coil forming a part of the current flow path, and the intermediate member is disposed between the field coil and the second end portion of the motor lead wire, the field coil and the second end portion of the motor lead wire being electrically connected to the intermediate member.

7. A starter according to claim 1, wherein the intermediate member is formed from a material having a larger electric resistance than the motor lead wire and the motor internal circuit and a lower thermal conductivity than the motor lead wire and the motor internal circuit.

8. A starter according to claim 1, wherein the intermediate member has a restricted portion forming a part of the current flow path through which the start-up current flows, said restricted portion having a reduced cross-section.

9. A starter according to claim 1, wherein the intermediate member is a generally T-shaped configuration having three protrusions, one of the three protrusions forming a central stem of the T-shaped configuration and being connected with the motor lead wire, the remaining protrusions forming arms of the T-shaped configuration and connected with the motor internal circuit, the intermediate member of T-shaped configuration having a cutout recess formed between the one protrusion and each of the remaining protrusions so as to form a restricted portion forming a part of a current flow path extending between the one protrusion and each of the remaining protrusions, the reduced portion having a reduced cross section.

10. A starter according to claim 1, wherein the intermediate member is made of iron.

11. A starter according to claim 1, wherein the intermediate member comprises a plate-like member having a surface to which the motor lead wire and/or a part of the motor internal circuit is welded.

12. A starter according to claim 11, wherein the surface of the plate-like intermediate member has a surface treatment to secure a desired welding strength.

13. A starter comprising:

an electric motor including a field system, an armature, a commutator disposed on the armature, and brushes disposed on the commutator, the motor generating a rotational force via the armature when a start-up current is supplied from a battery to the armature;

an electromagnetic switch having a battery terminal connected to the battery and a motor terminal connected to the motor, the electromagnetic switch being operable to electrically connect and disconnect the battery terminal and the motor terminal;

a current flow path formed inside the starter for the passage therethrough of the start-up current; and plural circuit parts electrically connected together to form the current flow path, wherein a selected one of the plural circuit parts has a conduction cut-off function that undergoes melting to cutoff the current flow path when the current flow path is subjected to a thermal load excessively larger than that in normal use, the selected circuit part being reduced in cross-sectional area over a length larger than one-half of the entire length of the selected circuit part so as to perform the conduction cut-off function.

14. A starter according to claim 13, wherein the selected circuit part is disposed inside the electric motor.

15. A starter according to claim 13, wherein the field system comprises a yoke forming a magnetic circuit, field poles fixedly mounted on an inner periphery of the yoke, and field coils wound around the respective field poles, and the selected circuit part having the conduction cut-off function is formed by the field coils.

16. A starter according to claim 15, wherein each of the field coils has a cross-sectional area reduced over the entire length of the field coil so as to perform the conduction cut-off function.

17. A starter according to claim 15, wherein each of the field coil has a winding-start end portion and a winding-finish end portion opposite the winding-start end portion, at least one of the winding-start end portion and the winding-finish end portion being prestressed with a tension imparted thereto.

18. A starter according to claim 13, wherein the plural circuit parts excluding the selected circuit part include a high-temperature avoidance part disposed adjacent to or in contact with a flammable part of the motor, the high-temperature avoidance part having a largest cross-sectional area and a smallest current density among the plural circuit parts.

19. A starter according to claim 18, wherein the current density of the high-temperature avoidance part is about one-half of a current density of a portion of the selected circuit part having a reduced cross-sectional area.

20. A starter according to claim 18, wherein the high-temperature avoidance part comprises a motor lead wire supported by a grommet made of rubber and forming the flammable part, the motor lead wire having a first portion disposed outside the motor and connected at an end to the motor terminal and a second portion disposed inside the motor.

21. A starter according to claim 18, wherein the high-temperature avoidance part comprises a motor lead wire supported by a grommet made of rubber and forming the flammable part, and a connection bar held by an insulator formed form a resin and forming the flammable part, the motor lead wire having a first portion disposed outside the motor and connected at an end to the motor terminal and a second portion disposed inside the motor, the connecting bar electrically connecting the motor lead wire and the field coils.

* * * * *